US007066583B2

(12) United States Patent
Usui

(10) Patent No.: US 7,066,583 B2
(45) Date of Patent: Jun. 27, 2006

(54) FILM FORMING APPARATUS AND METHOD OF DRIVING SAME, DEVICE MANUFACTURING METHOD, DEVICE MANUFACTURING APPARATUS, AND DEVICE

(75) Inventor: Takahiro Usui, Shiojiri (JP)

(73) Assignee: Seiko Epson Corporation (JP)

( * ) Notice: Subject to any disclaimer, the term of this patent is extended or adjusted under 35 U.S.C. 154(b) by 215 days.

(21) Appl. No.: 10/660,467

(22) Filed: Sep. 11, 2003

(65) Prior Publication Data

US 2004/0113960 A1 Jun. 17, 2004

(30) Foreign Application Priority Data

Sep. 12, 2002 (JP) ..... 2003-266975
Aug. 7, 2003 (JP) ..... 2003-206587

(51) Int. Cl.
*B41J 2/45* (2006.01)

(52) U.S. Cl. ..... 347/68; 347/57

(58) Field of Classification Search ..... 347/68–72, 347/54, 57, 56, 10, 11, 6
See application file for complete search history.

(56) References Cited

U.S. PATENT DOCUMENTS 6,409,300 B1 * 6/2002 Imanaka et al. ..... 347/19
6,431,674 B1 * 8/2002 Suzuki et al. ..... 347/10
2001/0050696 A1 12/2001 Suzuki et al.

FOREIGN PATENT DOCUMENTS

| | | |
|---|---|---|
| JP | 63-295269 | 12/1988 |
| JP | 1255548 | 10/1989 |
| JP | 1259961 | 10/1989 |
| JP | 03-190747 | 8/1991 |
| JP | 05-220433 | 8/1993 |
| JP | 05-281562 | 10/1993 |
| JP | 08-216425 | 8/1996 |
| JP | 09-029996 | 2/1997 |
| JP | 09-164702 | 6/1997 |
| JP | 10-006526 | 1/1998 |
| JP | 2000-037867 | 2/2000 |
| JP | 2000-117993 | 4/2000 |
| JP | 2001-047601 | 2/2001 |
| JP | 2003-001857 | 1/2003 |
| JP | 2003-251261 | 9/2003 |
| JP | 2004-042314 | 2/2004 |
| KR | 1989-0015868 | 11/1989 |

OTHER PUBLICATIONS

Communication from Japan re: counterpart application.
Communication from Korean Patent Office re: related application.

* cited by examiner

*Primary Examiner*—Lamson Nguyen
(74) *Attorney, Agent, or Firm*—Harness, Dickey & Pierce, P.L.C.

(57) ABSTRACT

A film forming apparatus and a method of driving this apparatus control vibrations imparted to a liquid by a discharge waveform (a first signal) that causes liquid drops to be discharged and by a micro vibration waveform (a second signal) that does not cause liquid drops to be discharged and that also imparts a shear rate to the liquid that lowers the viscosity of the liquid.

5 Claims, 17 Drawing Sheets

(b 1)

(b 2)

FILM FORMING APPARATUS AND METHOD OF DRIVING SAME, DEVICE MANUFACTURING METHOD, DEVICE MANUFACTURING APPARATUS, AND DEVICE

BACKGROUND OF THE INVENTION

1. Field of the Invention

The present invention relates to a film forming apparatus and to a method for driving the film forming apparatus and also to a device manufacturing method, a device, manufacturing apparatus, and a device.

2. Description of Related Art

The use of electronic devices and photoelectric devices such as liquid crystal display devices has increased along with the development of electronic instruments typified by computers and portable information terminal instruments. For example, this type of liquid crystal display device employs color filters, in order to colorize a display image. These color filters have a substrate and are formed by supplying red (R), green (G), and blue (B) ink in a predetermined pattern to the substrate. An example of such a method of supplying ink to the substrate is one in which an inkjet system of film forming apparatus is employed.

When an inkjet system is used a predetermined quantity of ink is supplied by being discharged onto the substrate from an inkjet head in a film forming apparatus. Devices that use a piezoelectric element are widely used as the ink discharging device. An example of this type of piezoelectric element is one formed by alternately stacking an electrode and a piezoelectric material in a sandwich configuration. This piezoelectric element has a structure in which a capacity (i.e., a pressure producing chamber) in the inkjet head is filled with ink, and this ink is then discharged by a pressure wave created by a deformation in the piezoelectric element.

In this type of inkjet head, because there are limits on the viscosity of an ink that can be discharged, it is difficult for high viscosity ink to be discharged. Therefore, conventionally, a technology is provided in which a heater is provided in an ink tank connected to the pressure chamber via a supply aperture. Alternatively, a technology is provided in which heaters are embedded in both the inkjet head and the ink tank. By using these technologies to lower the viscosity of high viscosity ink to a level where it can be discharged, industrial chemicals, with which it has conventionally been difficult to form a film, have become able to be used.

However, in the conventional technologies such as those described above, it is not possible to employ the method of lowering the viscosity by applying heat in the case of inks having rapid drying properties that contain low boiling point solvents or resin components, or in the case of inks whose properties are changed by the application of heat, as is described above. The problem has therefore existed that it has not been possible to improve conditions in which discharge is difficult.

The present invention was conceived in view of the above circumstances, and it is an object thereof to provide a film forming apparatus and a method for driving this film forming apparatus that enable a high viscosity liquid to be constantly kept at the low viscosity, and that enable liquid drops to be discharged stably, and also to a device manufacturing method, a device manufacturing apparatus, and a device.

SUMMARY OF THE INVENTION

The first aspect of the present invention is a method of driving a film forming apparatus that discharges liquid drops by impairing vibrations to a liquid has the steps of controlling the vibrations by a first signal that causes liquid drops to be discharged and a second signal that does not cause liquid drops to be discharged and that imparts a shear rate to the liquid that lowers a viscosity of the liquid.

According to the method of driving the film forming apparatus of the present invention because vibrations are imparted to the liquid by the second signals such that the liquid is not discharged as liquid drops, even if the liquid has a high viscosity or is not able to be heated, the liquid can be stably discharged.

Note that the term "shear rate" (also referred to as "strain rate") refers to the temporal rate of change in a deformation expressed by $\eta=\tau/U$ when, as a definition of the viscosity $\eta$, U is taken as the shear rate and $\tau$ is taken as the shear stress.

It is preferable that the second signal is transmitted before the first signal is transmitted or that the second signal is transmitted after the first signal is transmitted.

If this structure is employed, because vibrations are constantly imparted to the liquid, it is possible for the liquid to be always discharged stably.

It is also possible for the second signal to be transmitted at least once after a time when the first signal is transmitted and before a time when the first signal is transmitted again.

As a result, because vibrations are constantly imparted to the liquid, the liquid can be always discharged stably.

Note that it is preferable that the second signal is not transmitted if the length of a time interval between a time when the first signal is transmitted and a time when the first signal is transmitted again is shorter than a predetermined length of time. In this case, because the liquid is in a state of receiving the effect of the vibrations brought about by the first signal, there is no need to impart vibrations brought about by the second signal. This prevents any unnecessary consumption of energy.

It is also preferable that the liquid is a non-newtonian, pseudoplastic fluid body. In this case, because the shear rate of a non-newtonian pseudoplastic fluid body is increased if vibrations are imparted thereto, resulting in the viscosity thereof beings lowered, even the viscosity of a fluid body that has a high degree of viscosity can be lowered without that fluid body being heated, thereby enabling the flowability of the fluid body to be improved.

The second aspect of the present invention is a method of manufacturing a device, has the steps of forming a film on a substrate as a result of liquid drops being discharged by a liquid drop discharged apparatus, wherein the liquid drop discharge apparatus driven by the method of driving a film forming apparatus.

According to the method of manufacturing a device of the second aspect because a liquid call be stably discharged even if that liquid has a high level of viscosity and, moreover, cannot be heated, a film having the desired characteristics can be formed on a substrate.

The third aspect of the present invention is a film forming apparatus has a liquid drop discharge apparatus that discharges liquid drops, a pressure generating chamber provided in the liquid drop discharge apparatus, imparting vibrations to a liquid, a pressure generating device provided in the pressure generating chamber, and a control device that controls the pressure generating device such that vibrations are imparted to the liquid using: a first signal that causes the liquid drops to be discharged; and a second signal that does not cause the liquid drops to be discharged and that imparts a shear rate to the liquid that lowers a viscosity of the liquid.

According to the film forming apparatus of the third aspect, because a pressure generating device is controlled such that vibrations is imparted to the liquid based on the second signal that does not cause liquid drops to be discharged, a liquid can be stably discharged even if that liquid has a high level of viscosity and, moreover, cannot be heated.

In this case, it is preferable that the liquid is a non-newtonian, pseudoplastic fluid body. Because the shear rate of a non-newtonian pseudoplastic fluid body is increased if vibrations are imparted thereto, resulting in the viscosity thereof being lowered, even the viscosity of a fluid body that has a high degree of viscosity can be lowered without that fluid body being heated, thereby enabling the flowability of the fluid body to be improved.

It is preferable that the pressure generating device is a piezoelectric element that causes the liquid drops to be discharged by imparting vibrations to the pressure generating chamber.

If this structure is employed, there is no need to provide a separate mechanism, in order to impart vibrations to the liquid, thereby contributing to a reduction in both size and cost of the apparatus.

It is also possible for the pressure generating device to have a foam generating apparatus that causes the liquid drops to be discharged by generating foam in the liquid, and for a control apparatus to control a driving of the foam generating apparatus such that the generated foam expands or contracts.

In this case as well, there is no need to provide a separate mechanism in order to impart vibrations to the liquid, thereby contributing to a reduction in both size and cost of the apparatus.

The fourth aspect of the invention is a device manufacturing apparatus has a film forming apparatus that forms a film on a substrate as a result of liquid drops being discharged from a liquid drop discharge apparatus, wherein the film forming apparatus is the above described film forming apparatus.

The fifth aspect of the present invention is a device manufactured by the above described device manufacturing apparatus. According to the fifth aspect it is possible to obtain a high quality device on which a film is formed by stably discharged liquid drops.

DETAILED DESCRIPTION OF THE INVENTION

First Embodiment

Embodiments of the film forming apparatus and method for driving the film forming apparatus, and the device manufacturing method, device manufacturing apparatus, and device of the present invention will flow be described with reference to FIGS. 1 to 9.

Here a description is given of an example of when the film forming apparatus of the present invention is used for a filter manufacturing apparatus that manufactures color filters and the like employed in liquid crystal devices using ink in the form of a liquid. Note that liquids that can be used in the present invention are included in the term liquid. Namely, in addition to the aforementioned liquids, the term "liquid" also refers to liquid bodies that contain, for example, minute particles such as metals or the like.

Figure 1:
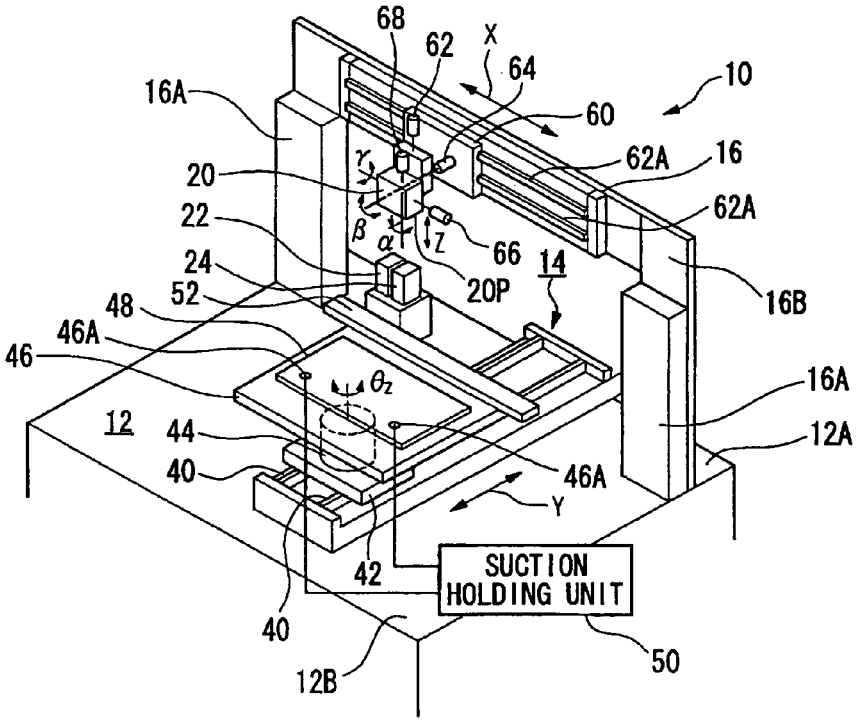
FIG. 1 is an external perspective view schematically showing a film forming apparatus that forms the filter manufacturing apparatus according to the first embodiment.

FIG. 1 is an external perspective view schematically showing, a film forming apparatus (an inkjet apparatus) 10 that forms a filter manufacturing apparatus (i.e., a device manufacturing apparatus). This filter manufacturing apparatus is provided with three film forming apparatuses 10 having substantially the same structure, and each film forming apparatus 10 is structured so as to discharge ink of the colors red (R), green (G), and blue (B) respectively onto a filter substrate.

The film forming apparatus 10 has a base 12, a first transporting unit 14, a second transporting unit 16, unillustrated electronic scales (i.e., a weight measuring unit). an inkjet head (i.e., a head) 20 forming a liquid drop discharge apparatus, a capping unit 22, and a cleaning unit 24 and the like. The first transporting unit 14, the electronic scales, the capping unit 22, the cleaning unit 24, and the second transporting unit 16 are each positioned on top of the base 12.

The first transporting unit 14 is preferably placed directly on top of the base 12. Furthermore, the position of the first transporting unit 14 is fixed in the Y axial direction. In contrast, the second transporting unit 16 is mounted standing vertically upright from the base 12 using the support pillars 16A, and is mounted on a rear portion 12A of the base 12. An X axial direction of the second transporting unit 16 is orthogonal to the Y axial direction of the first transporting unit 14. The Y axis is the axis that runs between the front portion 12B and the rear portion 12A of the base 12, while, in contrast, the X axis is the axis that runs in the left-right direction of the base 12. Each axis is horizontal.

The first transporting unit 14 has guide rails 40, and a linear motor, for example, can be used in the first transporting unit 14. A slider 42 of this linear motor type first transporting unit 14 is able to be positioned by moving in the Y axial direction along the guide rails 40.

The slider 42 is provided with a motor 44 for a θ axis. The motor 44 may be, for example, a direct drive motor, and a rotor of the motor 44 is fixed to a table 46. As a result, by supplying electricity to the motor 44, the rotor and the table 46 are rotated in the θ direction allowing the table 46 to be indexed (i.e., to have the rotation thereof calculated).

The table 46 positions and also holds a substrate 48. The table 46 also has a suction holding unit 50. The substrate 48 can be suctioned and held on the top of the table 46 by the operation of the suction holding unit 50 via a hole 46A in the table 46. On the table 46, there is provided a preliminary discharge area 52 used for an inkjet head (i.e., a liquid drop discharge apparatus) 20 to discharge ink, or alternatively, to test discharge (i.e., to make a preliminary discharge).

The second transporting unit 16 has a column 16B fixed to the support pillars 16A, and this column 16B has a linear motor type second transporting unit 16B. A slider 60 is able to be positioned by being moved in the X axial direction along guide rails 62A and is provided with an inkjet head 20 that serves as an ink discharge unit.

The inkjet head 20 has motors 62, 64, 66, and 68 that serve as a swing positioning units if the motor 62 is operated, the inkjet head 20 is able to be positioned vertically along the Z axis. This Z axis is a vertical direction orthogonal to both the X axis and the Y axis. If the motor 64 is operated, the inkjet head 20 is able to be positioned by being swung around the Y axis in the β direction. If the motor 66 is operated, the inkjet head 20 is able to be positioned by being swung around the X axis in the γ direction. If the motor 68 is operated, the inkjet head 20 is able to be swung around the Z axis in the a direction.

In this way, the inkjet head 20 shown in FIG. 1 is able to be positioned by being moved in a straight line in the Z axial direction along the slider 60, and can be swung the α, β, and γ directions to a particular position. The position or attitude of an ink discharge surface 20P of the inkjet head 20 can be accurately controlled relative to the substrate 48 on the table 46 side. A plurality of (for example, 120) nozzles that function as apertures that each discharge ink are provided on the ink discharge surface 20P of the inkjet head 20.

Figure 2A:
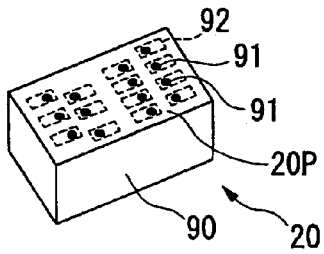
FIGS. 2A and 2B show a structure of an inkjet head, with FIG. 2A being an external perspective view of a head body and FIG. 2B being a partial enlarged view.

Here, a description will be given of an example of the structure of the inkjet head 20 with reference to FIGS. 2A and 2B. The inkjet head 20 uses, for example, piezoelectric elements (i.e., pressure generating units) and, as is shown in FIG. 2A, a plurality of nozzles 91 are formed on the ink discharge surface 20P of a head body 90. A Piezoelectric element 92 is provided for each of the nozzles 91.

Figure 2B:
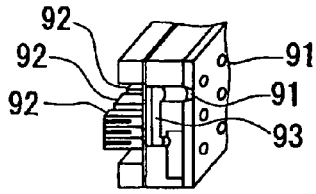

As is shown in FIG. 2B, the piezoelectric elements 92 are arranged to correspond to the nozzles 91 and ink chambers (i.e., pressure generating chambers) 93. and may be positioned, for example, between a pair of electrodes (not shown). The piezoelectric elements 92 are structured such that when energized they flex so as to protrude outwards. By supplying a predetermined voltage to the piezoelectric elements 92, the piezoelectric elements 92 are expanded and contracted in the horizontal direction in FIG. 2B, resulting in the ink being pressurized and a predetermined quantity of liquid liquid drops (i.e., ink liquid drops) being, discharged from the nozzles 91. As an ink jet system for the inkjet head 20 other than a piezo jet type that uses the piezoelectric elements 92, for example, a thermal inkjet type that uses thermal expansion may be employed.

Figure 3:
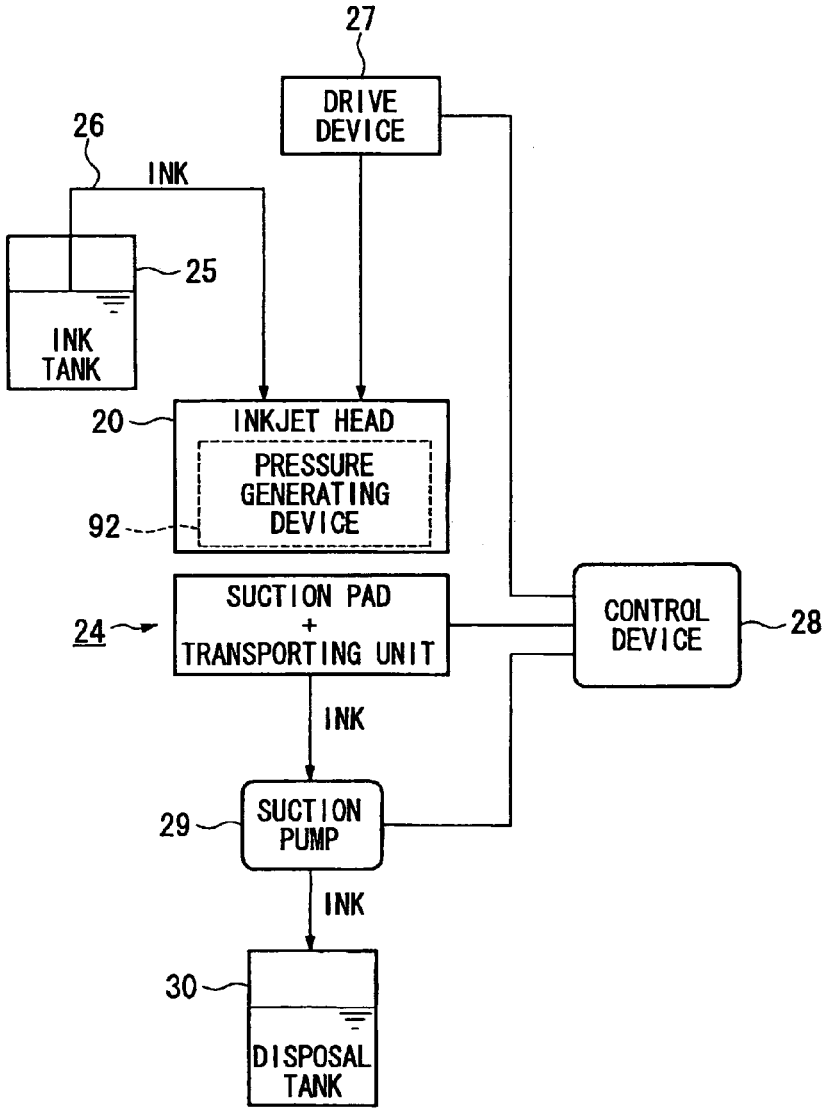
FIG. 3 is a view showing an ink supply system and drive control system for an inkjet head.
Figure 4:
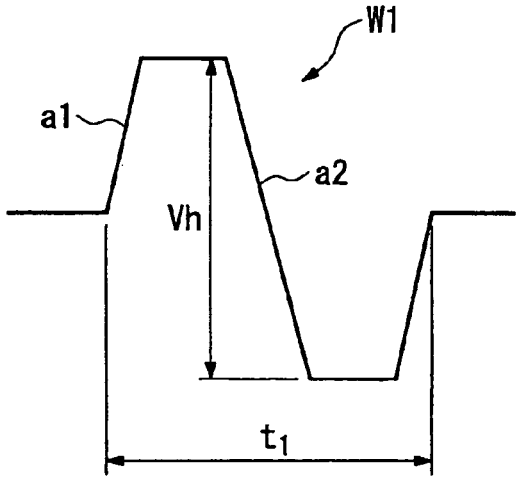
FIG. 4 is a view of a discharge waveform and also shows operation diagrams of an ink chamber corresponding to each signal element of the discharge waveform.
Figure 4:
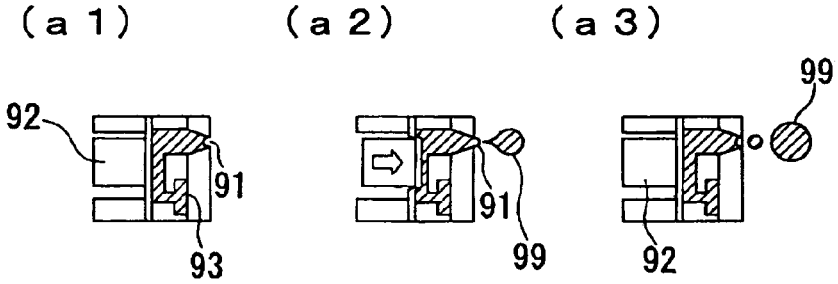

A drive control system and ink supply system for the inkjet head 20 is shown simply in FIG. 3. Ink stored in an ink tank 25 is supplied via an ink feed tube 26 to the ink jet head 20. Drive voltages that are appropriate to the type and temperature of the ink in order for a predetermined quantity of ink to be discharged are applied under the control of a control device 28 as a discharge waveform (i.e., a first signal) W1, such as is shown in FIG. 4, from an inkjet head drive device 27 to each of the nozzles 91 in the piezoelectric elements 92 provided in the inkjet head 20. By controlling the drive device 27 the control device 28 also causes the micro vibration waveform (i.e., a second signal) W2 shown in FIG. 5 to be applied as a drive waveform to the piezoelectric elements 92.

FIG. 4 is a schematic view showing a drive operation of the inkjet head 20 corresponding to the discharge waveform W1 and to each waveform portion (i.e., signal element) of the discharge waveform W1.

The discharge waveform W1 is set such that in the positive gradient waveform portion a1 the ink chamber 93 expands such that the volume thereof is increased, and ink corresponding to the size of the volume increase flows into the ink chamber 93. In the negative gradient waveform portion a2, an applied voltage Vh is applied causing the ink chamber to contract. The ink is thereby pressurized causing a predetermined quantity of ink to be discharged from the nozzles 91.

Figure 5:
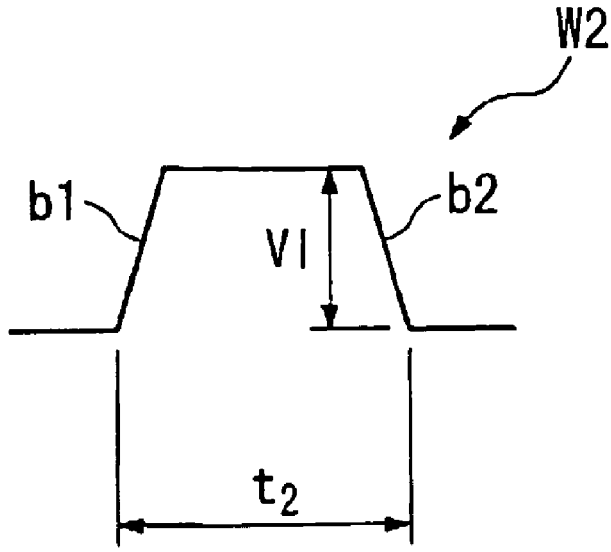
FIG. 5 is a view of a micro vibration waveform and also shows operation diagrams of am ink chamber corresponding to each signal element of the discharge
Figure 5:
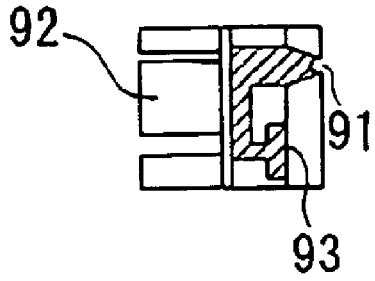
Figure 5:
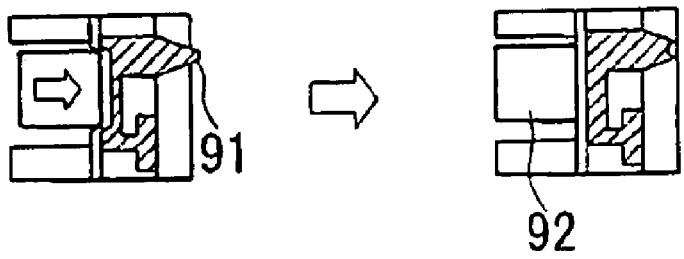

FIG. 5 is a schematic view showing a drive operation of the inkjet head 20 corresponding to the micro vibration waveform W2 and to each waveform portion (signal element of the micro vibration waveform W2.

The micro vibration waveform W2 is set such that in the positive gradient waveform portion b1 the ink chamber 93 expands. In the negative gradient waveform portion b2, an applied voltage V1 is applied causing the ink chamber 93 to contract and be pressurized, however, the applied voltage V1 is not large enough to cause ink to be discharged from the nozzles 91. Namely, a structure is employed in which, by applying the voltage of the micro vibration waveform W2 to the piezoelectric elements 92, the meniscus is made to vibrate minutely so as to repeatedly move away from and then move towards the nozzle surfaces.

Figure 7:
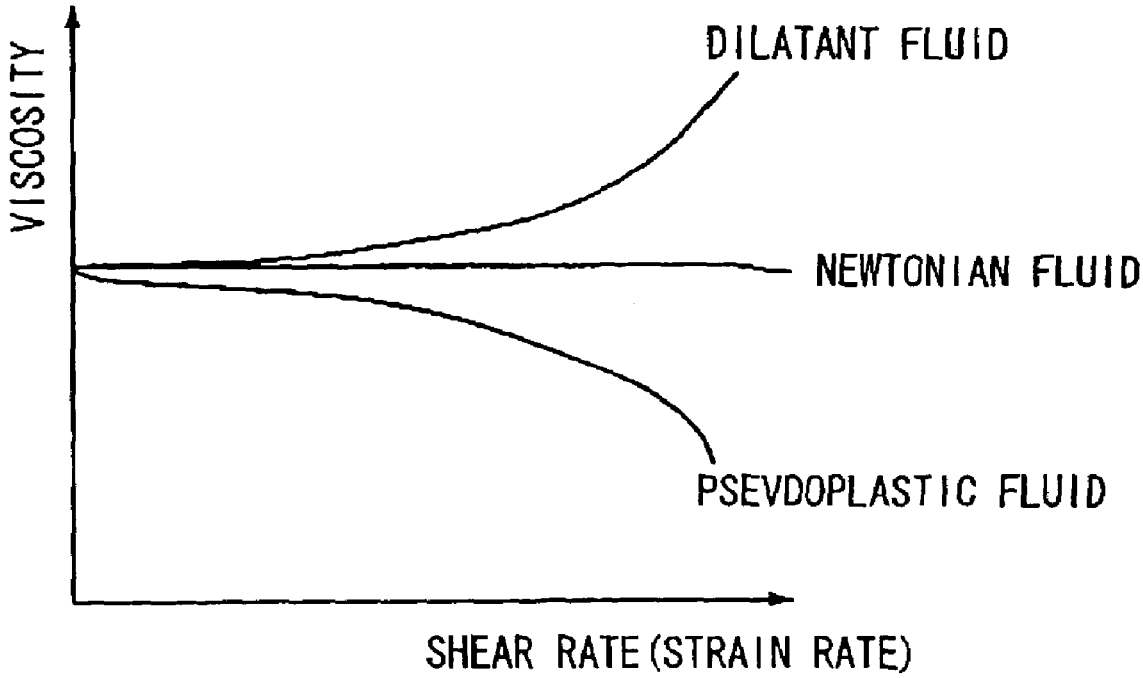
FIG. 7 is a view showing a relationship between the viscosity and shear rate of a fluid.

Generally, fluids are divided into Newtonian fluids whose viscosity does not depend on shear rate and non-Newtonian fluids whose viscosity changes depending on the shear rate. Non-Newtonian fluids can be further divided according to the tendency of the viscosity change into dilatant fluids and pseudoplastic fluids. FIG. 7 shows a relationship between the viscosity and shear rate (i.e., the strain rate) of each fluid. As can be seen from FIG. 7, for Newtonian fluids the viscosity is substantially constant even when the shear rate increases. Among non-Newtonian fluids, dilatant fluids have the property of the viscosity thereof increasing as the shear rate increases. Pseudoplastic fluids from among non-Newtonian fluids, however, have the property of the viscosity thereof decreasing as the shear rate increases.

Therefore, when non-Newtonian pseudoplastic fluid ink is used, by imparting micro vibrations to the inkjet head 20, it is possible to lower the viscosity as the ink shear rate rises. Accordingly, as described above, because it is possible to lower the viscosity of high viscosity ink, the fluidity of the ink is improved and the ink can be easily discharged.

Next, a description will be given using FIG. 6 of the operation of the inkjet head 20.

If the inkjet head 20 is filled with ink that has been temperature controlled to, for example, 40° C. and is fed from the ink tank 25 via the ink feed tube 26, then, as is described above, drive voltages having the drive waveforms shown in FIG. 4 and FIG. 5 are applied from the drive device 27, and the piezoelectric elements 92 corresponding to the respective nozzles 91 are driven at a predetermined interval and cycle.

Figure 6:
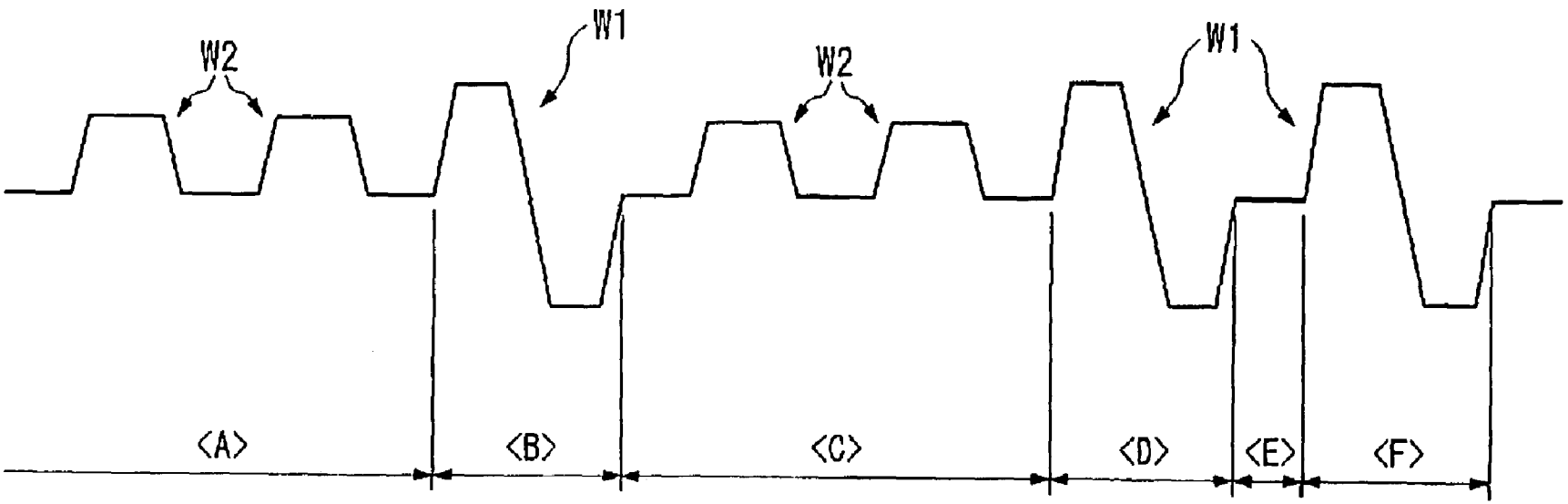
FIG. 6 is a view showing a transition of a drive waveform series obtained when a drive voltage is applied to a pressure generating device.

FIG. 6 is a view showing a transition in a series of drive waves obtained when drive voltage is applied to optional piezoelectric elements 92 during the driving of the inkjet head 20.

In the section B, a discharge waveform W1 that performs a first ink discharge is shown. Section A shows a wait interval (i.e., a wait time $t_A$) before the first discharge of ink. In section A, drive voltage is applied such that a plurality (twice in the diagram) of micro vibration waveforms W2 are formed. In the section D, a discharge waveform W1 that performs a second ink discharge is shown. Section C shows a wait interval (i.e., a wait time $t_C$) between the two discharges of ink in sections B and D. In section C, in the same way as in section A, drive voltage is applied such that a plurality (twice in the diagram) of micro vibration waveforms W2 are formed. The wait time $t_A$ and the wait time $t_C$ both have a sufficiently long predetermined time T compared with the generating time $t_2$ of the micro vibration waveforms W2. Thus, in the sections A and C, because vibration is imparted to the ink inside the inkjet heads 20 within a range that does not cause the ink to be discharged from the nozzles 91, when non-Newtonian, pseudoplastic fluid ink is used, then, as described above, it is possible to lower the viscosity of the ink as the shear rate thereof is raised. Note that the micro vibration waveforms W2 are not limited to being formed a plurality of times within the same section and naturally may also be formed only once within a single section.

Section F shows the discharge waveform W1 that performs a third ink discharge continuing on from the second ink discharge. Section E shows a wait interval (i.e., a wait time $t_E$) between the two discharges of ink in sections D and F. Because the wait time $t_E$ is shorter than the predetermined time T, in section E no drive voltage forming the micro vibration waveform W2 is applied. In this case, because section D and section F in which the discharge waveforms W1 are formed are adjacent to each other, in section E the ink inside the inkjet head 20 is affected by the vibrations imparted for the discharges in sections D and F. Namely, for example, because the liquid drop discharge of the subsequent discharge waveform W1 in the subsequent section F commences before the vibration of the discharge waveform W1 in the previous section D has completely dampened, constant vibration is imparted to the ink during this time, a predetermined shear rate is given to the ink and it is possible to lower the viscosity of the ink.

It is also possible for the cleaning unit 24 to periodically or occasionally clean the nozzles and the like of the inkjet head 20 during a filter manufacturing process or during a wait period. The capping unit 22 is provided to ensure that the ink discharge surface 20P is not in contact with the outside air during wait times when a filter is not being manufactured in order to prevent ink inside the nozzles in the ink jet head 20 from drying out. This cleaning unit 24 has a suction pad and a moving device (see FIG. 3) that under the control of the control device 28 moves the suction pad between a position where the suction pad is in contact with the inkjet head 20 and a position where it is removed from the inkjet bead 20. A suction apparatus 29 formed by a suction pump or the like is connected to the suction pad, and ink that has been suctioned by the suction pad is disposed of in a liquid disposal tank 30.

Returning now to FIG. 1 the electronic scales receive, for example, 5000 ink liquid drops from the nozzles of the inkjet head 20 in order to measure and control the weight of single liquid drops of ink discharged from the nozzles of the ink jet head 20. The electronic scales is able to substantially accurately measure the weight of a single liquid drop of ink by diving the weight of the 5000 ink liquid drops by 5000. Based on the measured weight of the ink liquid drops, the quantity of ink liquid drops discharged from the inkjet head 20 can be optimally controlled.

Next, the film forming process will be described.

When an operator supplies a substrate 48 to the top of the table 46 of the first transporting unit 14 from the front end side of the table 46, the substrate 48 is suctioned and held and then positioned on the table 46. The motor 44 is then operated and the end surface of the substrate 48 is set so as to be parallel to the Y axial direction.

Next, the inkjet head 20 moves in the X axial direction and is positioned above the electronic scales. A specified number of liquid drops (i.e., a specified number of ink liquid drops) is then discharged. This enables the electronic scales to measure the weight of, for example, 5000 liquid drops of ink, as described above, and then calculate the weight per single liquid drop of ink. A determination is then made as to whether or not the weight per single liquid drop of ink is within an appropriate predetermined range. If the weight is outside this appropriate range, then the applied voltage to the piezoelectric elements 92 and the like is adjusted, so that the weight per liquid drop of ink is within an appropriate range.

If the weight per single liquid drop of ink is correct, then the substrate 48 is positioned by being moved appropriately in the Y axial direction by the first transporting unit 14, and the inkjet head 20 is positioned by being moved appropriately in the X axial direction by the second transporting unit 16. After the inkjet head 20 has then performed a preliminary discharge of ink from all its nozzles onto the preliminary discharge area 52, it is moved relatively to the substrate 48 in the Y axial direction (in actual fact, the substrate 48 is moved in the Y axial direction relative to the inkjet head 20), and ink is discharged over a predetermined width from predetermined nozzles into a predetermined area on the substrate 48. When one relative movement of the inkjet head relative to the substrate 48 is completed, the inkjet head 20 is moved in steps of a predetermined size in the X axial direction relative to the substrate 48. Subsequently, ink is discharged while the substrate 48 is moving relative to the inkjet head 20. By repeatedly performing this operation a plurality of times, ink is discharged over the entire film forming area and a film is able to be formed.

Next, an example of the manufacturing of a color filter using this film forming process in be described with reference to FIGS. 8 and 9.

For the substrate 48, a transparent substrate that has an appropriate mechanical strength and that is highly optically transparent is used. For example, a transparent glass substrate, acrylic glass, a plastic substrate, plastic film and materials that have undergone surface processing with these materials may be appropriately used as the substrate 48.

Figure 9:
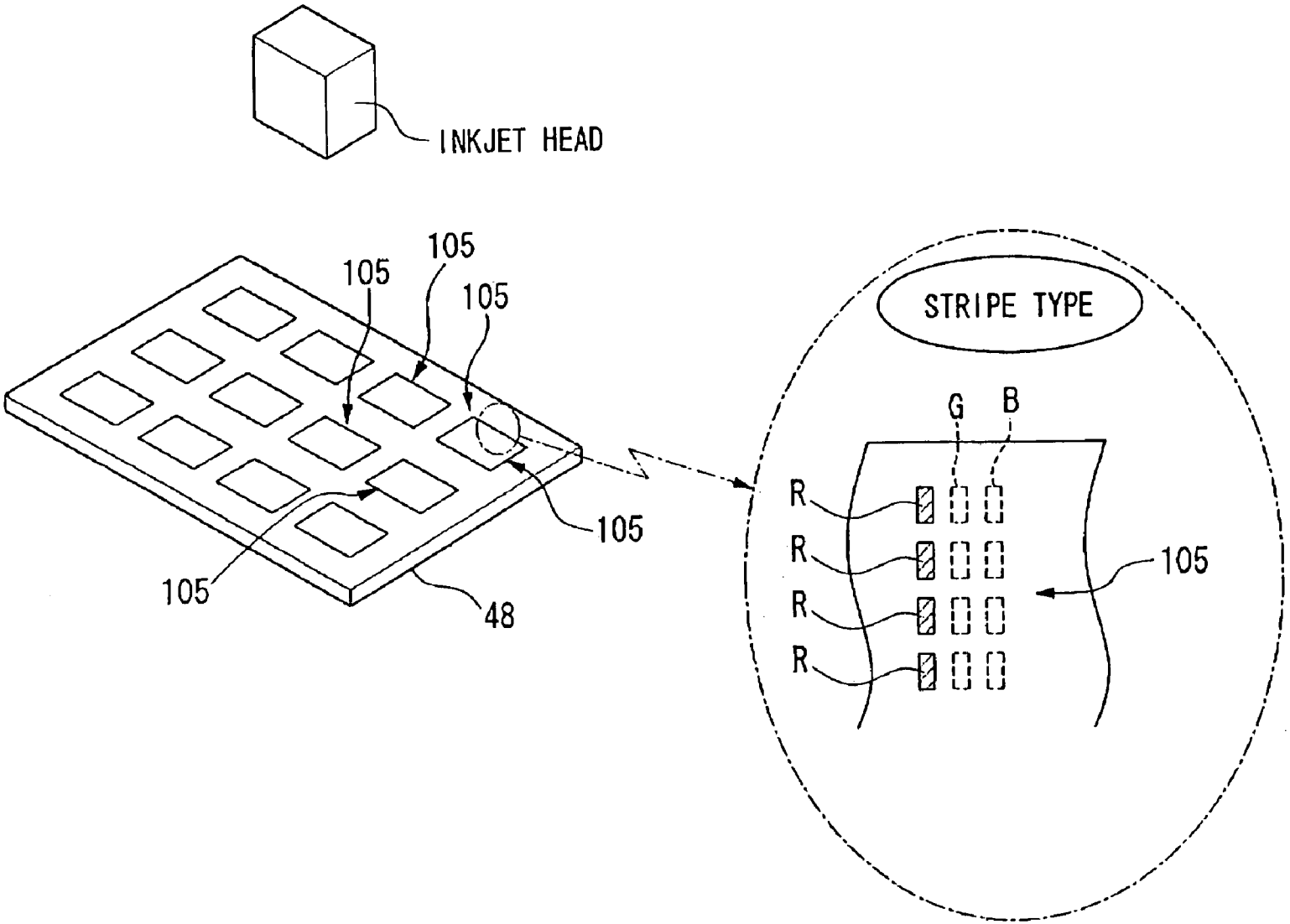
FIG. 9 is a view showing a substrate and a portion of a color filter region on the substrate.

For example, as is shown in FIG. 9, from the viewpoint of increasing productivity, a plurality of color filter areas 105 are formed in a matrix pattern on the rectangular substrate 48. By subsequently cutting the glass substrate 48, these color filter areas 105 can be used as color filters suitable for a liquid crystal display device.

As is shown in FIG. 9, for example, red (R) ink, green (G) ink, and blue (B) ink are arranged to form a predetermined pattern on the color filter areas 105. As is shown in FIG. 9, a conventional, known stripe type of formation pattern, a mosaic type, a delta type, and a square type may be used as the formation pattern. Because the stripe type enables a large number of nozzles to discharge ink at one time, it is particularly effective when the nozzle spacing is matched to the array pitch of the pixel portions by tilting the head 20.

FIGS. 8A to 8F show an example of a process to form a color filter area 105 corresponding to the substrate 48.

Figure 8A:
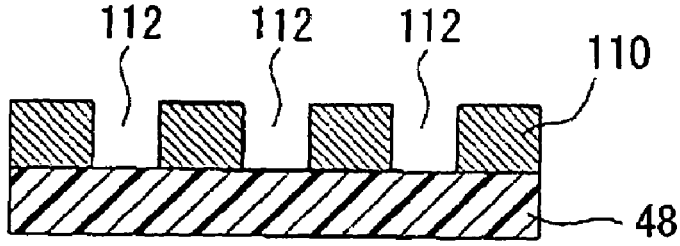
FIGS. 8A to 8F are views showing a series of procedures for manufacturing a color filter using a substrate.

In FIG. 8A, a black matrix 110 is formed on one surface of a transparent substrate 48. An optically non-transparent resin (preferably black in color) is coated to a predetermined thickness (for example, approximately 2 μm) on top of the substrate 48, which forms the foundation of the color filter, by a method such as spin coating. As a result, a black matrix 110 having a matrix configuration is obtained by a photolithographic method. The smallest display element that is surrounded by the lattice of the black matrix 110 is a filter element and may, for example, be a window with a width 30 μm long in the X axial direction and a length 100 μm loan, in the Y axial direction.

After the black matrix 110 has been formed, by applying heat using, for example, a heater or the like, the resin is baked onto the substrate 48.

Figure 8B:
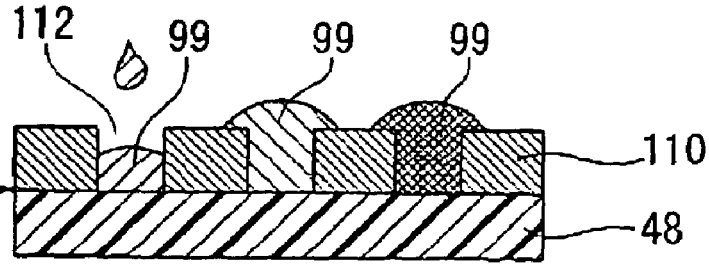

As is shown in FIG. 8B, ink liquid drops 99 are supplied to the filter elements 112. The quantity of ink liquid drops 99 is sufficient when the reduction in the volume of ink that occurs in the heating process is considered.

Figure 8C:
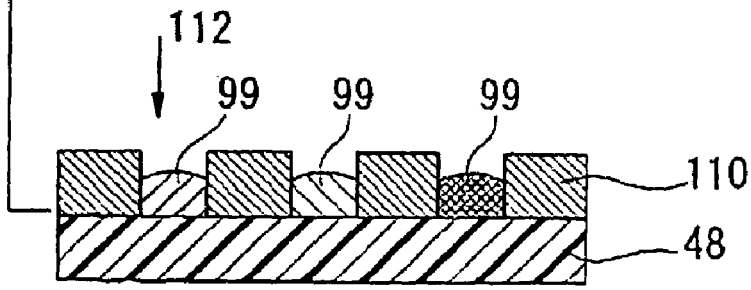

In the heating process in FIG. 8C, when all of the filter elements 112 on the color filter are filled with ink liquid drops 99, a heating process is performed using a heater. The substrate 48 is heated to a predetermined temperature (for example, approximately 70° C.). When the solvent in the ink evaporates the volume of the ink is reduced. When the volume reduction is substantial the ink discharge process and the heating process are repeated until a sufficient ink film thickness for a color filter is obtained. Through this process the ink solvent is evaporated and, ultimately, only the solid component of the ink is left to form a film.

Figure 8D:
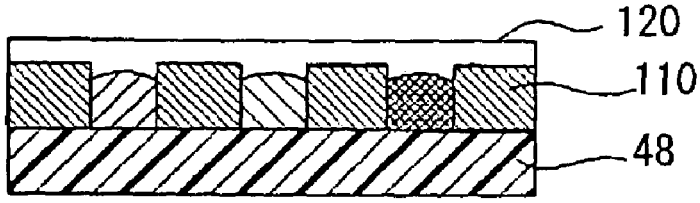

In the protective film forming process shown in FIG. 8D, heating at a predetermined temperature for a predetermined length of time is performed in order to completely dry the ink liquid drops 99. Once the drying is completed, a protective film 120 is formed that both protects the substrate 48 of the color filter on which the ink film is formed and flattens the surface of the filter. In the formation of this protective film 120, for example, a spin coating method, a roll coating method, a ripping method, or the like may be employed.

Figure 8E:
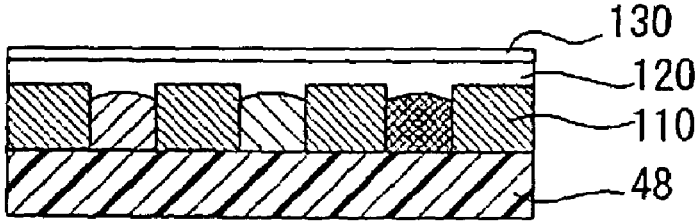

In the transparent electrode forming process shown in FIG. 8E, a transparent electrode 130 is formed over the entire protective film 120 by a method such as a sputter method or a vacuum deposition method or the like.

Figure 8F:
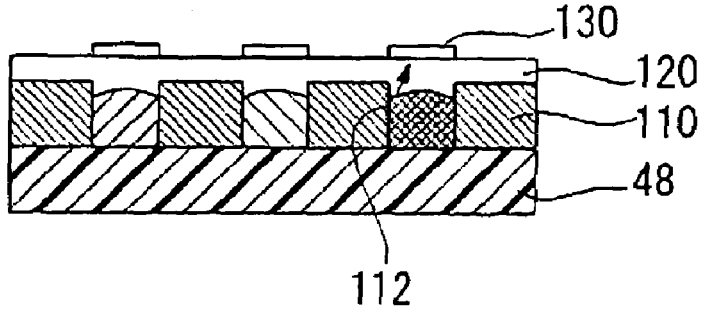

In the patterning process shown in FIG. 8F, the transparent electrode 130 is patterned fuller into pixel electrodes that correspond to the aperture portions of the filter elements 112. Note that if a thin film transistor (TFT) or the like is used to drive a liquid crystal, then this patterning is unnecessary.

During the above described film forming process it is desirable that the ink discharge surface 20P of the inkjet head 20 is wiped regularly or occasionally by the cleaning unit 24.

As has been described above, in the present embodiment, particularly when a pseudoplastic fluid ink is used, because it is possible to lower the viscosity of the ink without heating the ink, a stable discharge from the head is made possible even when using high viscosity ink or inks that cannot be heated or even inks that have rapid drying properties. This enables a film with desired discharge characteristics to be formed on a substrate. As a result, a device that is manufactured using ink discharged from the inkjet head 20 can be provided with a film having a desired configuration and size, thereby enabling product quality to be maintained.

Moreover, in the present embodiment, because vibration is imparted to the ink during a wait time when the ink is not being discharged it is possible to keep the ink inside the inkjet head 20 constantly at a low viscosity. Furthermore, because the piezoelectric elements 92 that are driven when ink is discharged from the inkjet head 20 also function is pressure generating devices to form the micro vibration waveforms W2 that do not cause ink to be discharged, there is no need to provide separate vibration imparting devices enabling the apparatus to be reduced in both size and cost. Moreover, because no ink heating device is provided, there is no wait time until the ink reaches a predetermined temperature, thereby providing excellent productivity. Moreover, because there is no need to apply a high voltage to the pressure generating devices, the lifespan of the pressure generating devices can be lengthened.

Second Embodiment

As the second embodiment of the present invention, a description is given of when the film forming apparatus of the first embodiment is used as a manufacturing apparatus of an electro luminescence (EL) display device, with reference made to FIGS. 10 to 19.

An EL display device is an element having a structure in which a thin film containing fluorescent inorganic and organic compounds is sandwiched between a cathode and an anode. Electrons and holes are injected into this thin film and recombined thereby generating excitons. Light is generated by using the light (fluorescence and phosphorescence) emitted when the excitons are deactivated. Among fluorescent materials that are used for these EL display elements, materials that present luminescent colors of each of red, green, and blue, namely, luminescent layer forming materials and materials forming hole injection/electron transporting layers are used as inks, and by patterning each one on an element substrate such as a TFT, TFD, or the like using the device manufacturing apparatus of the present invention, a self luminescent full color EL device can be manufactured.

In this case, a wall separating each single pixel is formed using resin resist in the same way as for a black matrix of a color filter. In addition, as a preliminary processing to the discharge of liquid drops, for example, a surface processing such as plasma, UV processing, coupling, or the like is performed on the substrate in older to enable discharged liquid drops to adhere more easily to the surface of the layer that will form the sub-layer, and also to prevent the walls from repelling discharged liquid drops and causing them to become mixed with liquid drops of adjacent segments. Subsequently to this, the material for forming the hole injection/transporting layer are supplied as liquid drops, and a device is manufactured after the hole injection/transporting layer or forming process to form a film, and, in the same manner, the luminescent layer forming process to form the luminescent layer have been performed.

Figure 10:
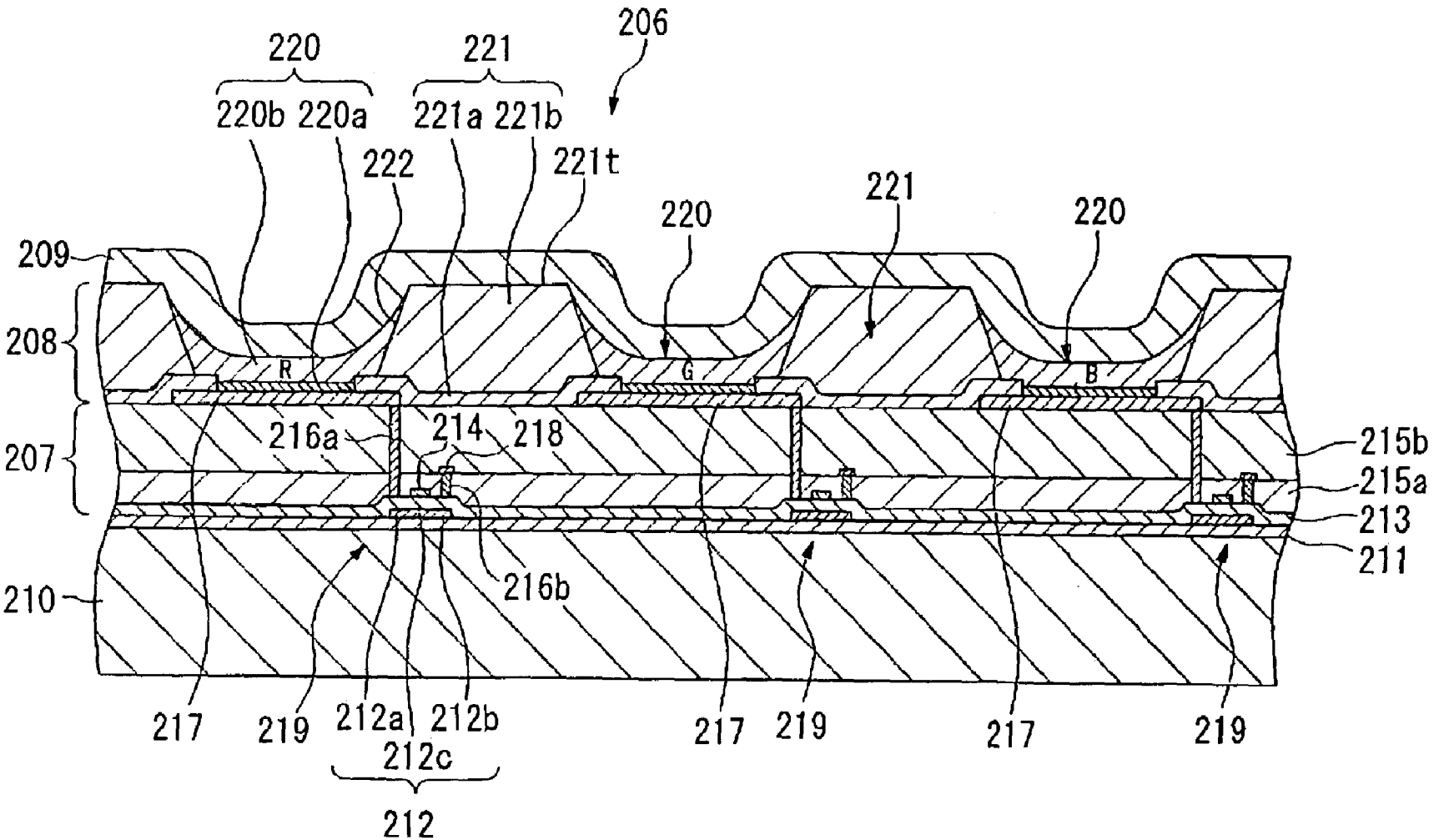
FIG. 10 is a cross-sectional view showing main elements of a display apparatus according to the second embodiment.

FIG. 10 is a cross-sectional view showing a display area of an organic EL display device (referred to below simply as the display device 206).

This display device 206 is schematically formed with a circuit element portion 207, a light emitting element portion 208, and a cathode 209 stacked on a substrate 210.

In the display device 206, light emitted from the light emitting element portion 208 towards the substrate 210 passes through the circuit element section 207 and the substrate 210, and is emitted outward towards an observer. In addition, light emitted from the light emitting element portion 208 towards the opposite side from the substrate 210 is first reflected by the cathode 209 and then passes through the circuit element section 207 and the substrate 210 and is then emitted outward towards an observer.

A substrate protective film 211 formed by a silicon oxide film is formed between the circuit element portion 207 and the substrate 210. An island shaped semiconductor film 212 formed from polysilicon is formed on the substrate protective film 211 (on the light emitting element portion 208 side). In the areas to the left and right of the semiconductor film 212, a source area 212*a* and a drain area 212*b* are formed respectively by high density cation indentation. The central portion where there is no cation indentation forms a channel area 212*c*.

A transparent gate insulation film 213 is formed covering the substrate protective film 211 and the semiconductor film 212 on the circuit element portion 207, and a gate electrode 214 formed, for example, from Al, Mo, Ta, Ti or W, or the like is formed on the gate insulation film 213 at a position corresponding to the channel area 212*c* of the semiconductor film 912. A transparent first interlayer insulation film 215*a* and a second interlayer insulation film 215*b* are formed on the gate electrode 214 and the gate insulation film 213. Contact holes 216*a* and 216*b* that connect respectively to the source area 212*a* and the drain area 212*b* of the semiconductor film 212 are formed penetrating through the first and second interlayer insulation films 215*a* and 215*b*.

A transparent pixel electrode 217 that has been patterned in a predetermined configuration and is formed from ITO or the like is formed on the second interlayer insulation film 215*b*. This pixel electrode 217 is connected to the source area 212*a* via the contact hole 216*a*.

A power line 218 is provided on top of the first interlayer insulation filly) 215*a*. The power line 218 is connected to the drain area 212*b* via the contact hole 216*b*.

In this way, thin film transistors 219 that are used for driving and are connected to each pixel electrode 217 are formed on the circuit element section 207.

The light emitting element portion 208 is schematically formed by function layers 220 that are stacked on each of the plurality of pixel electrodes 217 and by bank portions 221 that are provided between each pixel electrode 217 and function layer 220 and that partition each function layer 220.

A light emitting element is formed by the pixel electrodes 217, the function layer 220, and the cathode 209 provided on top of the function layer 220. Note that the pixel electrodes 217 are formed by being patterned in a rectangular configuration, as seen in plan view, and the bank portions 221 are formed between each pixel electrode 217.

The bank portions are formed by an inorganic bank layer 221*a* (i.e., a first bank layer) formed, for example, from an inorganic material such as SiO, $SiO_2$, $TiO_2$, and the like and by an organic bank layer 221*b* formed with a trapezoidal cross section from resist having excellent heat resistance and solvent resistance such as acrylic resins polyimide resin or the like that is stacked on top of the inorganic bank layer 221*a*. Each bank portion 221 is positioned such that a portion thereof is placed on top of peripheral edge portions of the pixel electrodes 217.

An aperture portion 222 that becomes gradually wider as it moves upwards from the pixel electrode 217 is formed between each bank portion 221.

The function layers 220 are formed by a hole injection transporting layer 220*a* that is stacked on top of the pixel electrode 217 within the aperture portion 222, and by a light emitting layer 220*b* that is formed on top of the hole injection/transporting layer 220*a*. Note that it is also possible to form further functional layers having a further range of functions adjacent to the light emitting layers 220*b*. For example an electron transporting layer might also be formed.

The hole injection transporting layers 220*a* have a function of transporting holes from the pixel electrode 217 side and injecting them into the light emitting layer 220*b*. These hole injection/transporting layers 220*a* are formed by discharging a first composition of matter (corresponding to a type of liquid material of the present invention) that contains a hole injection/transporting layer forming material. Compounds of a polythiophene derivatives such as polyethylene dioxythiophene and the like and polystyrene sulfonate, for example, are used as the hole injection/transporting layer forming material.

The light emitting layer 220*b* emits light of one of red (R), green (G), or blue (B), and is formed by discharging a second composition of matter (corresponding to a type of liquid material of the present invention) that contains a light emitting layer forming material (i.e., a light emitting material). As the light emitting layer forming material it is possible to use, for example, paraphenylene vinylene derivatives, polyphelylene derivatives, polyfluorolene derivatives, polyvinyl carbazole, polythiophene derivatives, perylene based dyes, coumarin base dyes, rhodamine based dyes or materials obtained by adding rubrene, perylene, 9, 10-diphenyl anthracene, tetraphenyl butadiene, Nile Red, Coumarin 6, quinacridone and the like to the above polymer materials.

As a solvent (i.e., a non-polar solvent) for the second composition of matter, one that is insoluble in the hole injection/transporting layer 220*a* is preferable, for example, cyclohexylbenzene, dihydrobenzofuran, trimethylbenzene, tetramethylbenzene, and the like can be used. By using a non-polar solvent such as this for the second composition of matter of the light emitting layer 220*b*, the light emitting layer 220*b* can be formed without having to redissolve the hole injection/transporting layer 220*a*.

In the light emitting layer 220*b*, a structure is employed in which electrons injected from the cathode 209 are recombined in the light emitting layer with holes injected from the hole injection transporting layer 220*a* so as to generate light.

The cathode 209 is formed such that it covers the entire surface of the light emitting element portion 209, so as to form a pair with the pixel electrode 217 and have a function of supplying current to the function layer 20. Note that a sealing member (not shown) is provided above the cathode 209.

Next, a manufacturing process to manufacture the display device 206 of the present embodiment will be described with reference to FIGS. 11 to 19.

Figure 11:
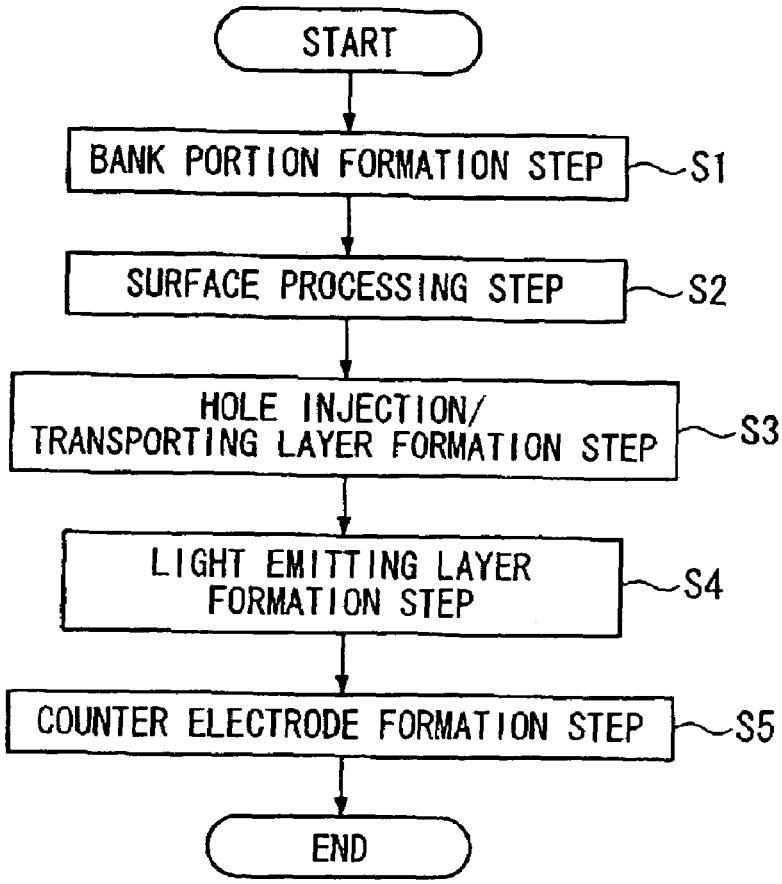
FIG. 11 is a flow chair describing a process for manufacturing a display apparatus according to the second embodiment.

As is shown in FIG. 11, the display device 206 is manufactured via a bank portion formation step (S1), a surface processing step (S2), a hole injection/transporting layer formation step (S3), a light emitting layer formation step (S4), and a counter electrode formation step (S5). Note that the manufacturing steps are not limited to those shown in this example, and, where necessary, some steps may be removed or additional steps added.

Figure 12:
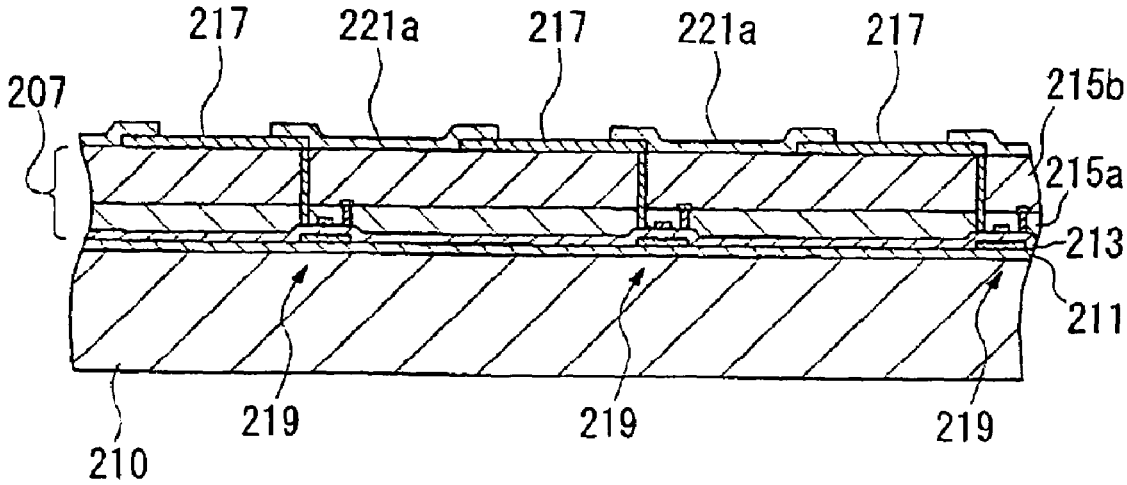
FIG. 12 is a process diagram describing the formation of inorganic bank layers.

Firstly, as is shown in FIG. 12, in the bank portion formation step (S1), the inorganic bank layer 221*a* is formed on top of the second interlayer insulation film 215*b*. This inorganic bank layer 221*a* is formed by first forming an inorganic film in the formation position, and by then patterning the inorganic film rising photolithography technology. At this time, a portion of the inorganic bank layer 221*a* is formed such that it is superimposed on top of peripheral edge portions of the pixel electrodes 217.

Figure 13:
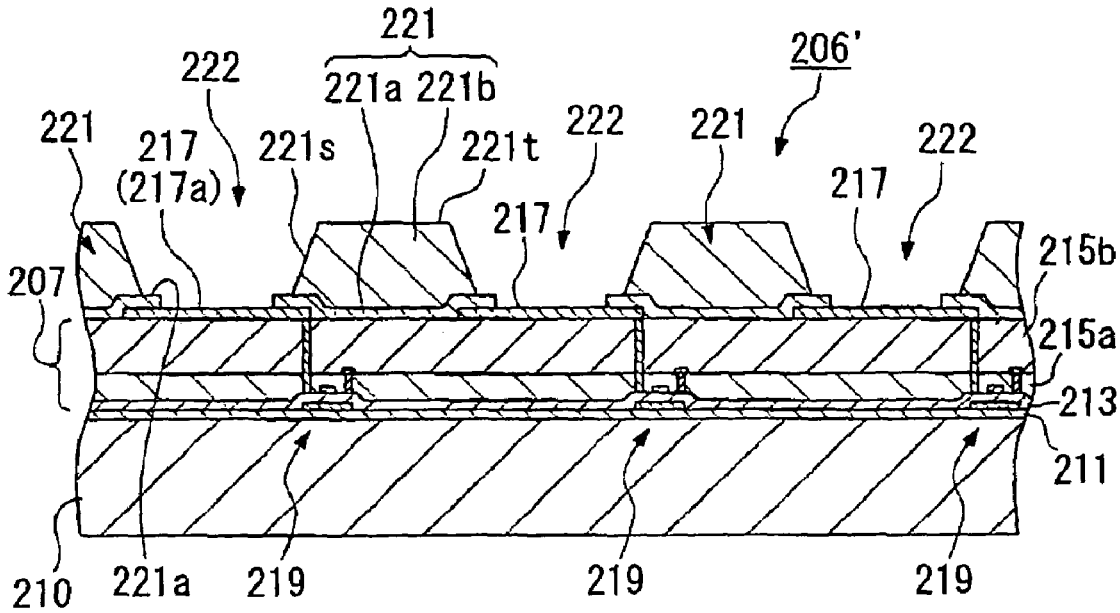
FIG. 13 is a process diagram describing the formation of organic bank layers.

Once the inorganic bank layer 221*a* has been formed, as is shown in FIG. 13, the organic bank layer 221*b* is formed on top of the inorganic bank layer 221*a*. In the same way as for the inorganic bank layer 221*a*, the organic bank layer 221*b* is formed by patterning using photolithography technology.

The bank portions 221 are formed in this manner. Accompanying this, the aperture portions 222 are formed opening upward from the pixel electrodes 217 between each bank portion 221. These aperture portions 222 prescribe the pixel area (corresponding to a type of liquid material area of the present invention).

In the surface processing step (S2), lyophilizing processing and repellency processing are performed. The areas where the lyophilizing processing is carried out are a first stacking portion 221*a*' of the inorganic bank layer 221*a* and the electrode surface 217*a* of the pixel electrode 217. These areas undergo surface processing to become lyophilic, for example, by plasma processing using oxygen as the processing gas. This plasma processing doubles as a processing to clean the ITO, which is the pixel electrode 217.

The repellency processing is performed on the wall surface 221*s* of the organic bank layer 221*b* and the top surface 221*t* of the organic bank layer 221*b*. It is performed, for example, by fluoridizing the surfaces (so that they become repellant to liquids) by plasma processing using 4 methyl fluoride as the processing gas.

By performing this surface processing step when the function layers 220 are formed using the inkjet head 20, it is possible to make the liquid land more reliably on the pixel areas. It is also possible to prevent liquid that has landed on the pixel areas from leaking out from the aperture portions 222.

By performing the above steps a display device base body 206' (corresponding to a type of display base body of the present invention) is obtained. This display device body 206' is placed on the table 46 of the film forming apparatus 10 shown in FIG. 1, and the hole injection/transporting layer formation step (S3) and the light emitting layer formation step (S4) described below are then performed.

In the hole injection/transporting layer formation step (S3), the first composition of matter containing hole injection/transporting layer forming material is discharged from the inkjet head 20 into the aperture portions 222, which are the pixel areas. Drying processing and heating processing are then performed resulting in hole injection/transporting layers 220*a* being formed on the pixel electrodes 217.

This hole injection/transporting layer formation step is performed after the same steps as the color filter formation steps of the first embodiment have been completed.

Figure 14:
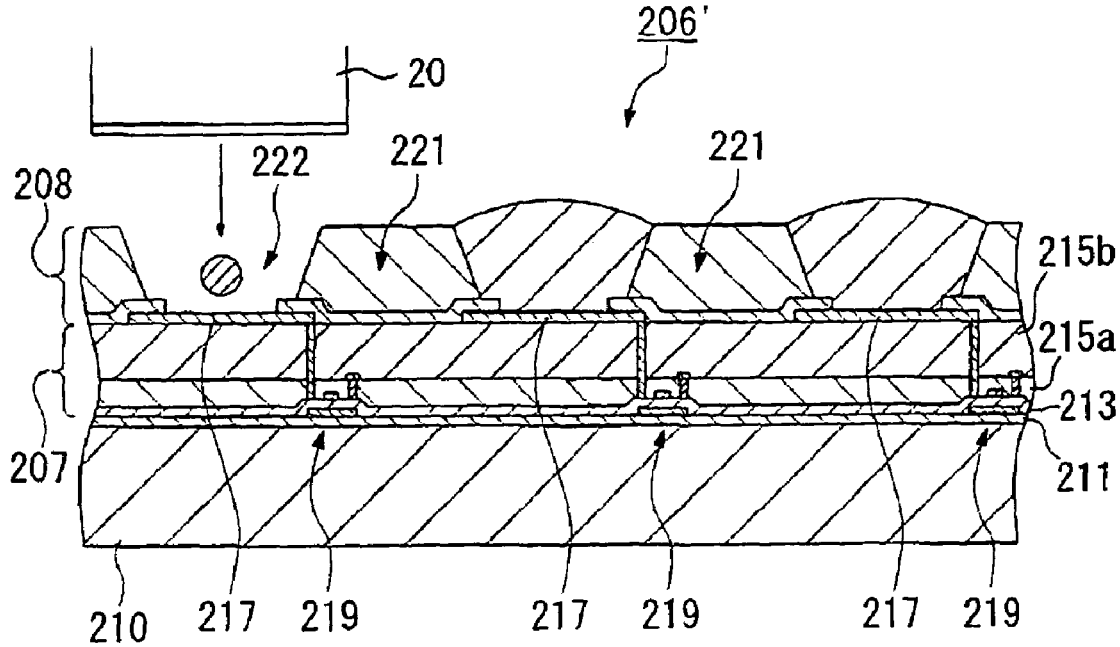
FIG. 14 is a process diagram describing a process for forming hole injection/transporting layers.

In the liquid drop discharge step, as is shown in FIG. 14, a predetermined quantity of the first composition of matter containing hole injection/transporting layer forming material, is made to strike as liquid drops the pixel area (namely, inside the aperture portions 222) on the display device base body 206'. In this case as well, because the waveform configuration of the drive pulse is set, as is described above, a consistently stable discharge of liquid drops can be maintained.

Figure 15:
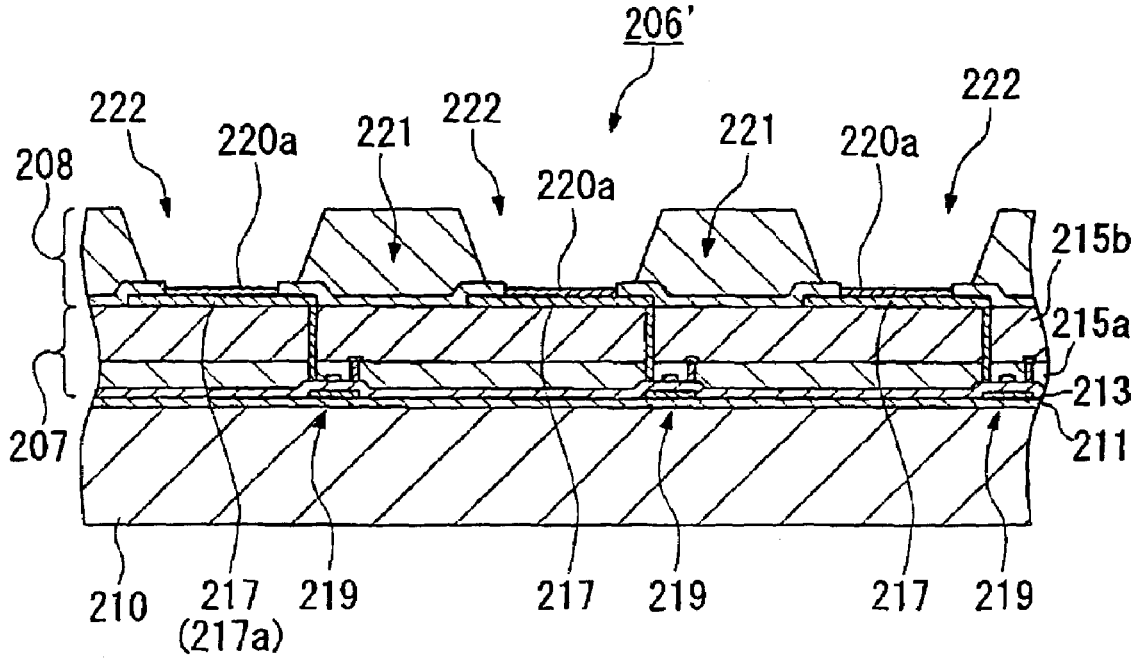
FIG. 15 is a process diagram describing a state when hole injection/transporting beds have been formed.

Subsequently, by performing the drying process and the like, the first composition of matter that has been discharged is dried, polar solvents contained in the first composition of matter are evaporated and, as is shown in FIG. 15, a hole injection/transporting layer 220*a* is formed on the electrode surface 217*a* of each pixel electrode 217.

Once a hole injections transporting layer 220*a* has been formed in each pixel area, as has been described above, the hole injection/transporting layer formation step is ended.

Next, the light emitting layer formation step (S4) will be described. In this light emitting layer formation step, as has been described above, in order to prevent the redissolution of the hole injection/transporting layers 220*a*, a non-polar solvent that is incapable of dissolving the hole injection/transporting layer 220*a* is used as the solvent for the second composition of matter used when forming the light emitting layer.

However, in contrast, because the hole injection/transporting layers 220*a* have low affinity with non-polar solvents, the concern exists that even when the second composition of matter containing a non-polar solvent is discharged onto the hole injection/transporting layers 220*a*, it will not be possible to cause the hole injections transporting layer 220*a* to adhere closely to the light emitting layer 220*b*, or that the light emitting layer 220*b* will not be able to be uniformly coated.

Therefore, in order to heighten the affinity of the surface of the hole injection/transporting layer 220*a* with the non-polar solvent and with the light emitting layer forming material, it is preferable that a surface processing (i.e., a surface improvement processing) be performed before the formation of the light emitting layer. This surface processing is performed by coating a surface improving material, which is either the same solvent as the non-polar solvent of the second composition of matter used when forming the light emitting layer or a similar solvent thereto, onto the hole injection/transporting layers 220*a*, and then dry in, this solvent.

By performing this type of processing, it is easier for the surface of the hole injection/transporting layer 220*a* to have an affinity with a non-polar solvent, and in the subsequent processing it is possible to uniformly coat the second composition of matter containing the light emitting layer forming material onto the hole injection/transporting layers 220*a*.

Moreover, in this light emitting layer formation step as well, the same step is implemented as is performed in the color filter formation step of the above described first embodiment.

Figure 16:
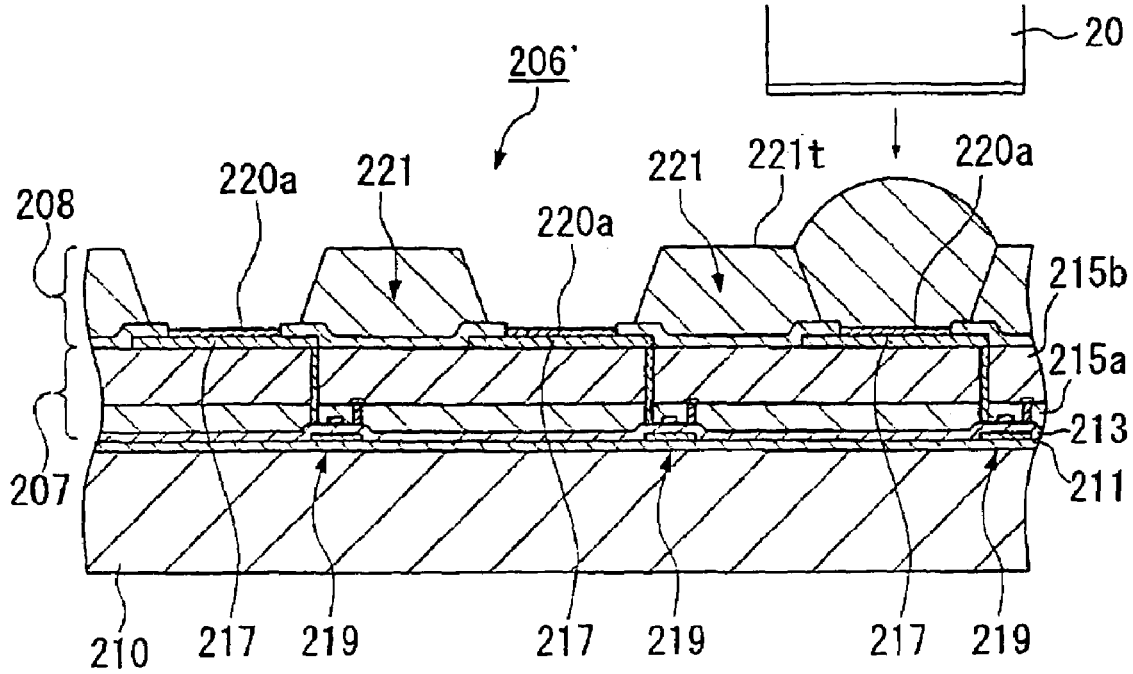
FIG. 16 is a process diagram describing a process for forming a blue light emitting layer.

Namely, in the liquid drop discharge step, as is shown in FIG. 16, a predetermined quantity of the second composition of matter containing it a light emitting layer forming material that corresponds to one of the respective colors (blue (B) in the example in FIG. 16) is discharged as liquid drops into the inside of the pixel areas (i.e., the aperture portions 222). In this case as well, because the waveform configuration of the drive pulse is set, as is described above, a consistently stable discharge of liquid drops can be maintained.

The second composition of matter that is discharged into the pixel areas spreads over the top of the hole injection/transporting layers 220*a* and fills the interior of the aperture portions 222. Note that, even if the second composition of matter escapes from the pixel areas and lands on the top surface 221*t* of the bank portion 221, because the top surface 221*t* has undergone repellency processing, as described above, the second composition of matter easily rolls back into the aperture portions 222.

Figure 17:
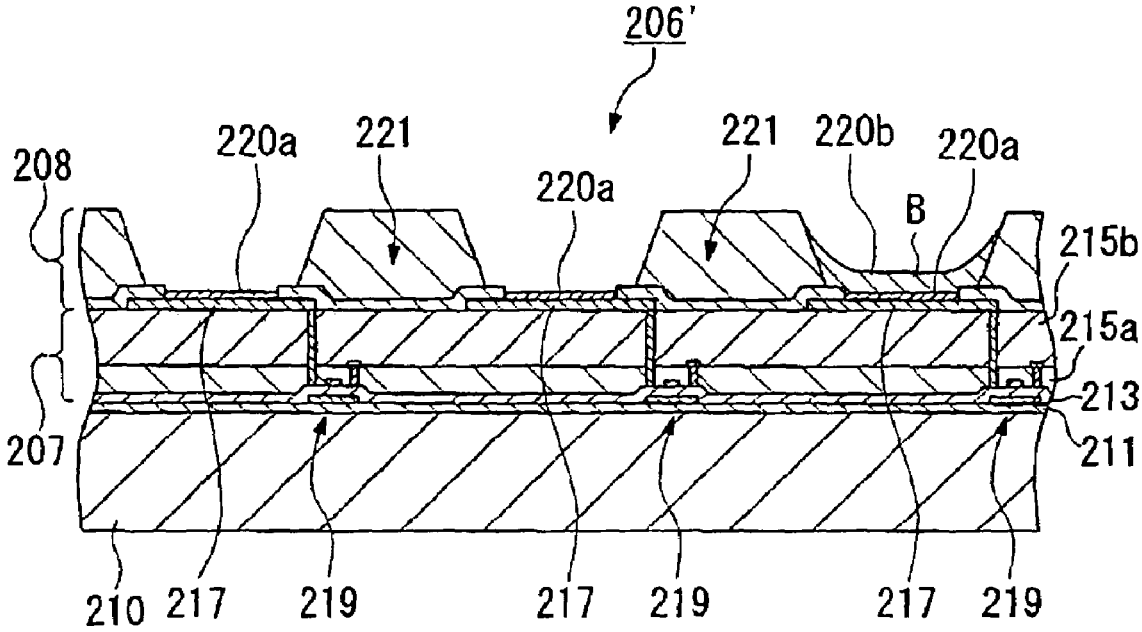
FIG. 17 is a process diagram describing a state when a blue light emitting layer has been formed.

Subsequently, by performing the drying process and the like, the second composition of matter that has been discharged is dried, non-polar solvents contained in the second composition of matter are evaporated, and, as is shown in FIG. 17, a light emitting layer 220*b* is formed on the hole injection/transporting, layer 220*a*. In the case shown in the drawings, a light emitting layer 220*b* that corresponds to the color blue (B)

Figure 18:
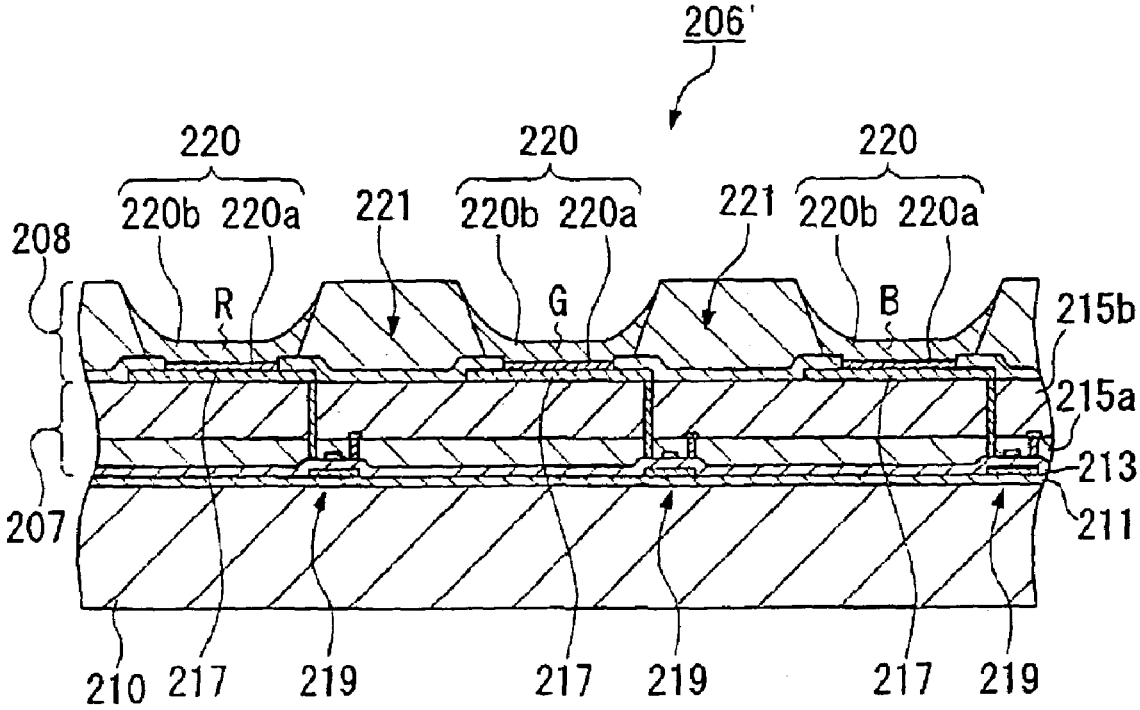
FIG. 18 is a process diagram describing a state when light emitting layers of each color have been formed.

Thereafter, as is shown in FIG. 18, using the same steps as were performed for the light emitting layer 220*b* corresponding to the color blue (B) in sequence, light emitting layers 220*b* for the other colors (red (R) and green (G)) are formed. Note that the formation sequence of the light emitting layers 220*b* is not limited to that given in the above example, and any formation sequence may be employed. For example, it is also possible to decide the formation sequence in accordance with the type of material used to form the light emitting layers.

Once light emitting layers 220*b* have been formed for each pixel area, the light emitting layer formation step is ended.

As is described above, the function layer 220, namely, the hole in injection/transporting layer 220*a* and the light emitting layer 220*b* are formed on the pixel electrodes 217. The routine then proceeds to the counter electrode formation step (S5).

Figure 19:
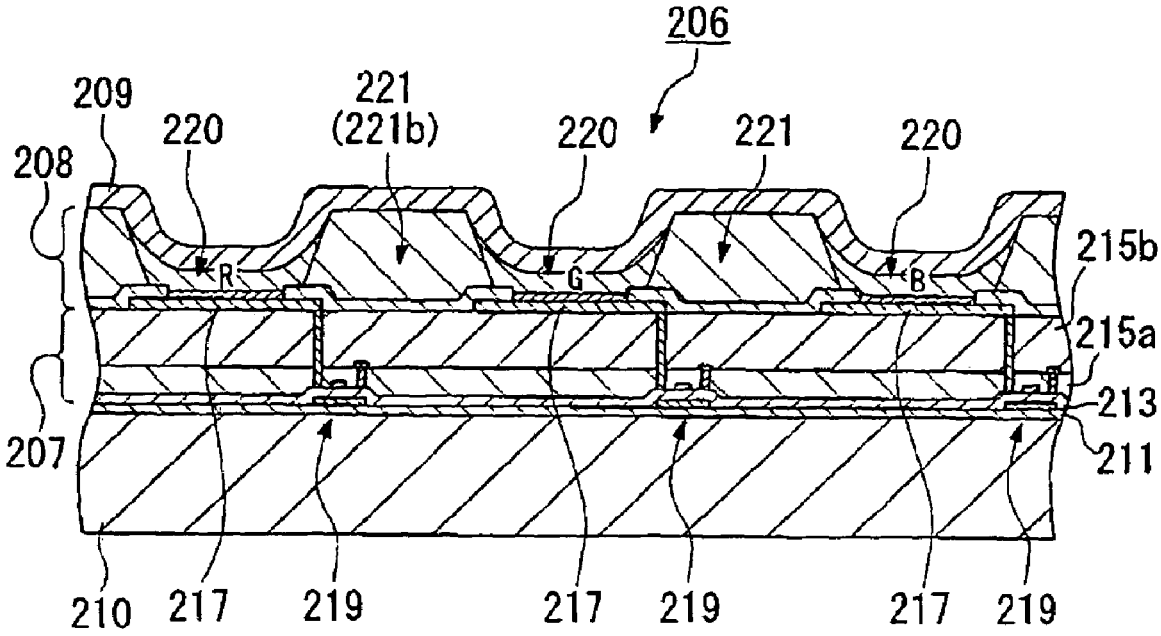
FIG. 19 is a process diagram describing the formation of a cathode.

In the counter electrode formation step (S5), as is shown in FIG. 19, the cathode (i.e., a counter electrode) 209 is formed over the entire surface of the light emitting layer 220*b* and the organic bank layer 221*b* using, for example, an evaporation method, a sputter method, a CVD method or the like. In the present embodiment the cathode 209 may be formed, for example, by stacking calcium and aluminum layers.

Protective layers such as an Al film, an Ag film, and $SiO_2$ or SiN or the like to prevent oxidization may be applied as is appropriate to the top portion of the cathode 209.

After the cathode 209 has been formed in this manner other processing such as a sealing processing to seal the top portion of the cathode 209 with a sealing member, or wiring processing or the like is performed, finally resulting in a display device 206 being obtained.

An EL device manufactured in this manner can be used for segment displays or the static image displays of full screen simultaneous light emission, or may be applied to what are known as low information fields such as pictures, characters, labels, and the like, or alternatively, may be used as a light source having points, lines, or masks. Furthermore, by using this EL device to drive not only passive drive display elements, but also active elements such as TFT and the like, a high-brightness, full color display device with excellent response can be obtained.

As described above, in the present embodiment, in particular when a pseudoplastic fluid type of liquid is used as the liquid for forming the hole injection/transporting layer 220*a* and the light emitting layer 220*b*, because it is possible to lower the viscosity of the liquid without applying heat thereto, a stable discharge from the head is made possible even when using high viscosity liquid bodies or liquid bodies that cannot be heated or even liquid bodies that have rapid drying properties. This enables a film with desired discharge characteristics to be formed on a substrate. As a result, an EL device that is manufactured using a liquid discharged from the ink jet head 20 can be provided with a film having a desired configuration and size, thereby enabling product quality to be maintained.

Moreover in the present embodiment, because vibration is imparted to the liquid during a wait time when the liquid is not being discharged, it is possible to keep the liquid inside the inkjet head 20 constantly at a low viscosity. Furthermore, because the piezoelectric elements 92 that are driven when the liquid is discharged from the inkjet head 20 also function as pressure generating devices to form the micro vibration waveforms W2 that do not discharge liquid, there is no need to provide separate vibration imparting devices, thereby enabling the apparatus to be reduced in both size and cost. Moreover, because no liquid heating device is provided, there is no wait time until the liquid reaches a predetermined temperature, thereby providing excellent productivity. Moreover, because there is no need to apply a high voltage to the pressure generating devices, the lifespan of the pressure generating devices can be lengthened.

Third Embodiment

As the third embodiment of the present invention, a description of when the film forming apparatus of the first embodiment is used as a manufacturing apparatus for a plasma display device (referred to below simply as the display device 325) will now be given.

Figure 20:
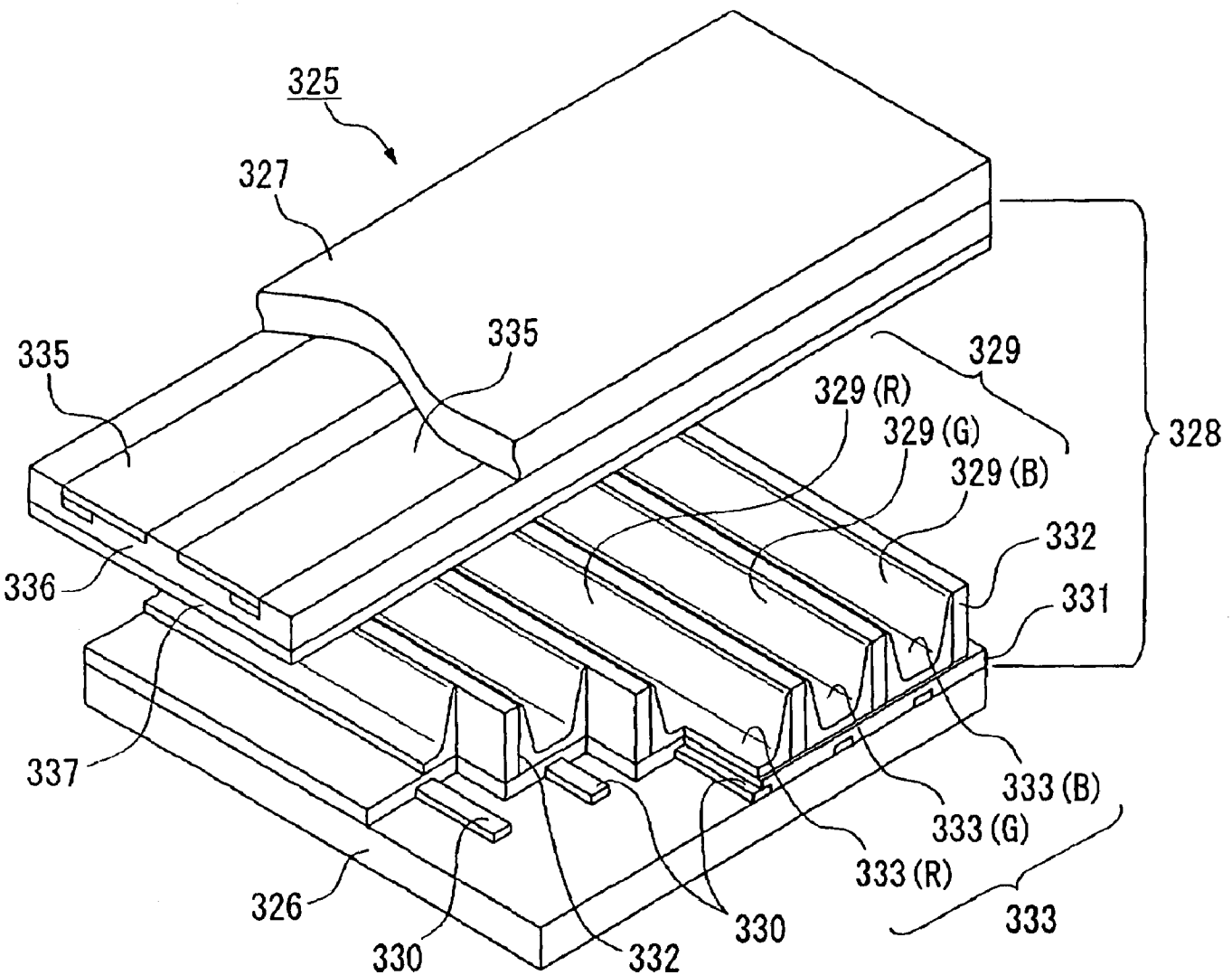
FIG. 20 is an exploded perspective view showing main elements of a display apparatus according to the third embodiment.

FIG. 20 is an exploded perspective view of principal portions of a plasma display device.

In FIG. 20, the display device 325 is shown with a portion thereof cut away.

This display device 325 is schematically formed so as to include a first substrate 326 and a second substrate 327 that are placed facing each other, and by a discharge display section 328 formed between the two substrates. The discharge display section 328 is formed by a plurality of discharge chambers 329. Three discharge chambers 329, namely, a red discharge chamber 329 (R), a green discharge chamber 329 (G), and a blue discharge chamber 329 (B), from among the plurality of discharge chambers 329 form one group and are arranged so as to form one pixel.

Address electrodes 330 are formed in a stripe configuration at predetermined intervals on a top surface of the first substrate 326. A dielectric layer 331 is formed so as to cover top surfaces of the address electrodes 330 and the first substrate 326. Partitions 332 are positioned on top of the dielectric layer 331 between each address electrode 330 so as to run parallel to each address electrode 330. As is shown in the drawing, the partitions 332 include a portion that extends on both sides in the transverse direction of the address electrodes 330 and a portion (not shown) that extends in a direction orthogonal to the address electrodes 330.

Areas partitioned by the partitions 332 from the discharge chambers 329.

Fluorescent bodies 333 are positioned inside the discharge chambers 329. The fluorescent bodies 333 emit fluorescent light in one of the colors red (R), green (G), or blue (B). On the bottom portion of a red discharge chamber 329 (R) is provided a red fluorescent body 333 (R), while a green fluorescent body 333 (G) and a blue fluorescent body 333 (B) are provided respectively on the bottom of a green discharge chamber 329 (G) and a blue discharge chamber 329 (B).

On a bottom surface (in the view shown in the drawing) of the second substrate 327 a plurality of display electrodes 335 are provided in a stripe configuration at predetermined intervals in a direction orthogonal to the address electrodes 330. A dielectric layer 336 and a protective layer 337 formed from MgO or the like are formed covering the plurality of display electrodes 335.

The first substrate 326 and the second substrate 327 are positioned facing each other and are adhered together such that the address electrodes 330 and the display electrodes 335 are orthogonal to each others Note that the address electrodes 330 and the display electrodes 335 are connected to an AC power supply (not shown).

By supplying power to the respective electrodes 330 and 335 the fluorescent bodies 333 in the discharge display section 328 are excited so as to emit light, thereby making a color display possible.

In the present embodiment, the address electrodes 330, the display electrodes 335, and the fluorescent bodies 333 can be formed using the manufacturing, apparatus 10 shown in FIG. 1.

An example of the formation process of the address electrodes 330 of the first substrate 326 will now be given.

In this case, the following steps are performed with the first substrate 326 positioned on the table 46.

Firstly, in the liquid drop discharge step, a liquid containing a conductive film wiring forming material is discharged as liquid drops onto an address electrode formation area. This liquid has conductive fine particles dispersed in a dispersion medium to serve as the conductive film wiring forming material, and is a pseudoplastic fluid. Metallic fine particles containing gold, silver, copper, palladium, or nickel or the like, or conductive polymers may be used as the conductive fine particles.

In this case as well, because the waveform configuration of the drive pulse is set, as is described above, a constant, stable discharge of liquid drops can be achieved.

Subsequently, by performing a drying process on the liquid that has been discharged, the dispersion medium contained in the liquid is evaporated, thereby forming the address electrodes 330.

Note that the example given above is for the formation of all address electrode 330, however, it is possible to form both the display electrodes 335 and the fluorescent bodies 333 using the above described steps.

When forming the display device 335, in the same way as for the address electrodes 330, a liquid containing a conductive film wiring forming material is discharged as liquid drops onto display electrode formation areas.

When forming fluorescent bodies 333, a liquid containing fluorescent material corresponding, to the respective colors (R, G, B) is discharged as liquid drops from the inkjet head 20 so as to land in the discharge chamber 329 of the corresponding color.

As described above, in the present embodiment, in particular, when a pseudoplastic fluid liquid is used as the liquid for forming the address electrodes 330, the display electrodes 335, and the fluorescent bodies 333, because it is possible to lower the viscosity of the liquid without heating the liquid, a stable discharge from the head is made possible even when using high viscosity liquid bodies or liquid bodies that cannot be heated or even liquid bodies that have rapid drying properties. This enables a film with desired discharge characteristics to be formed on a substrate. As a result, a plasma display device 325 that is manufactured using a liquid discharged from the inkjet head 20 can be provided with a film having a desired configuration and size, thereby enabling product quality to be maintained.

Moreover, in the present embodiment, because vibration is imparted to the liquid during a wait time when the liquid is not being discharged, it is possible to keep the liquid inside the inkjet head 20 constantly at a low viscosity. Furthermore, because the piezoelectric elements 92 that are driven when the liquid is discharged from the inkjet head 20 also function as pressure generation devices to form the micro vibration waveforms W2 that do not discharge liquid, there is no need to provide separate vibration imparting devices, thereby enabling the apparatus to be reduced in both size and cost. Moreover because no liquid heating device is provided, there is no wait time until the liquid reaches a predetermined temperature, thereby providing excellent productivity. Moreover, because there is no need to apply a high voltage to the pressure generating devices, the lifespan of the pressure generating devices can be lengthened.

Fourth Embodiment

As the fourth embodiment of the present invention, a description of when the film forming apparatus of the first embodiment is used, for example, as a manufacturing apparatus for an image forming apparatus that employs an electron emission element such as a field emission display (FED) will now be given.

A variety of layouts can be employed for the electron emission elements. One example thereof is a ladder configuration. In this configuration each of a large number of electron emission elements arranged in a row are connected by both ends thereof, and a large number of rows of electron emission elements are aligned (called the row direction). Electrons from the electron emission element are then controlled using control electrodes (called a grid) that are laid on top of the electron emission elements in a direction (called the column direction) orthogonal to the row direction wiring. Another example different from this is one in which a plurality of electron emission elements are laid in a matrix configuration in an X direction and a Y direction, and one electrode of the plurality of electron emission elements arranged in the same row are connected in common to the wiring in the X direction, while the other electrode of the plurality of electron emission elements arranged in the same row are connected in common to the wiring in the Y direction. This type of layout is known as a simple matrix layout. Firstly, this simple matrix layout will be described in detail below.

Generally, electron emission elements have three characteristics. Namely, above a threshold voltage, emission electrons from surface conduction type electron emission elements can be controlled by peak values and widths of pulse voltages applied between opposing element electrodes. In contrast, below the threshold voltage, there is practically no emission. According to this characteristic, even if a large number of electron emission elements are laid out, if a pulse form of voltage is appropriately applied to each element, then it is possible to select surface conduction type electron emission elements and control their electron emission quantities in accordance with input signals.

A description will now be given using FIG. 21 of an electron source substance obtained by laying out a plurality of electron emission elements based on the principle described above.

Figure 21:
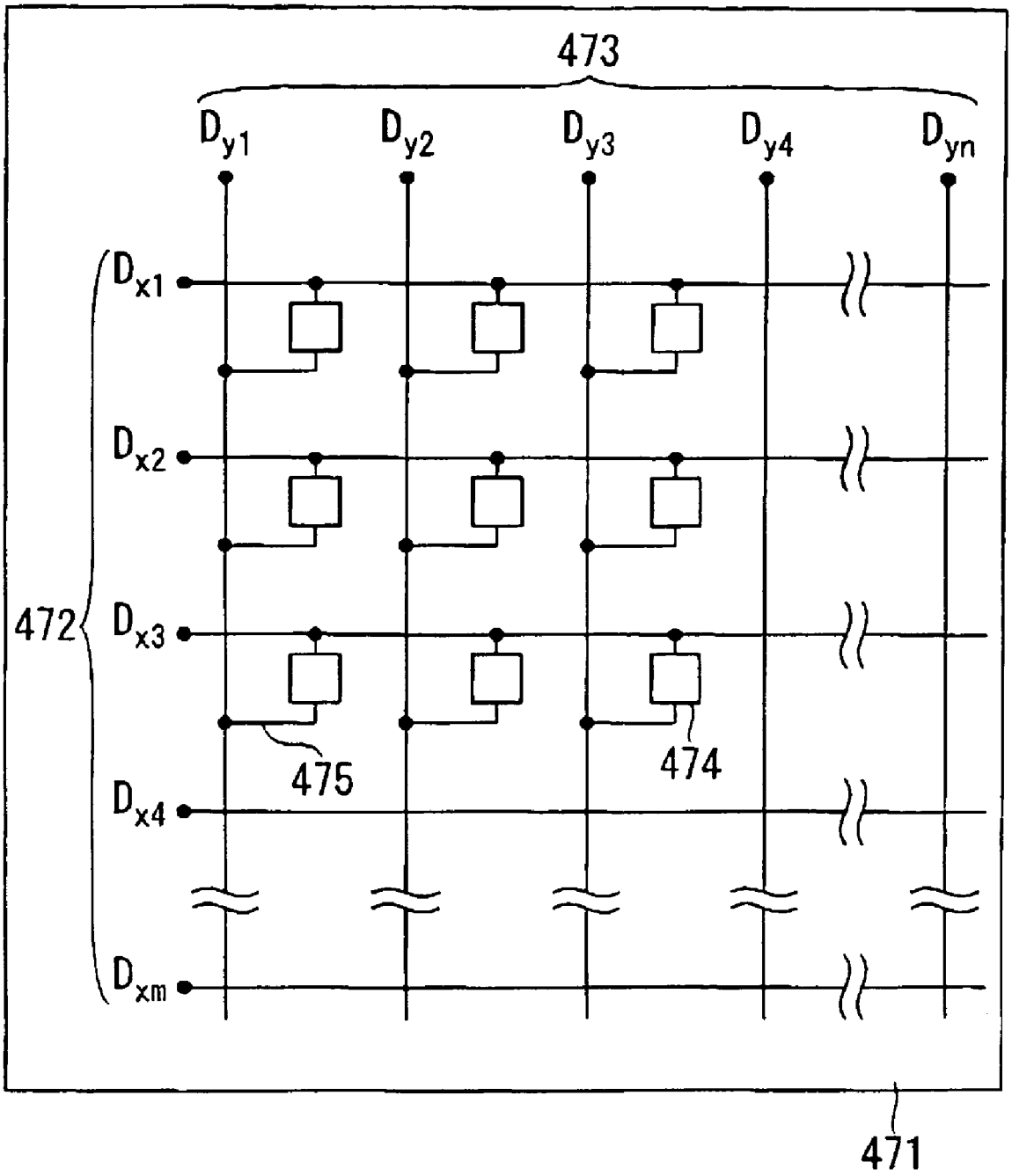
FIG. 21 is a typical view showing an example of an electron source having a simple matrix pattern according to the fourth embodiment.

In FIG. 21, 471 is an electron source substrate, 472 is wiring in the X direction, and 473 is wiring in the Y direction, 474 is an electron emission element and 475 is a connecting wire.

m number of X direction wires 472 made up of $D_{x1}$, $D_{x2}$, $D_{x3}$, . . . , $D_{xm}$ can be constructed from conductive metal or the like and formed using a vacuum evaporation method, a print method, a sputter method, a liquid drop discharge method or the like. The material, film thickness, and width of the wiring can be selected as is appropriate. The wiring 473 in the Y direction is made up of n number of wires $D_{y1}$, $D_{y2}$, $D_{y3}$, . . . , $D_{yn}$, and is formed in the same manner as the wiring 472 in the X direction. An interlayer insulation layer (not shown) is provided between the m number of Wires 472 in the X direction and the n number of wires in the Y direction 473 (m and n are both positive integers) so that the two sets of wiring are electrically separated. The interlayer insulation layer (not shown) may be formed from $SiO_2$ or the like using a vacuum evaporation method, a print method a sputter method or the like. For example, the film thickness, materials, and manufacturing method can be appropriately set such that a desired configuration is formed on the entire surface or a portion thereof of the substrate 471 on which the X direction wiring 472 is formed, and can withstand the potential difference in the portion where the X direction wiring intersects the Y direction wiring 473. The X direction wiring 472 and die Y direction wiring 473 are both drawn out as external terminals.

The pair of element electrodes (not shown) forming the electron emission element 474 are electrically connected respectively to the m number of X direction wires and the n number of Y direction wires by connections 475 formed from conductive metal or the like. The constituent elements of the material forming the wiring 472 and the wiring 473, of the material forming the wiring 475, and of the material forming the pair of element electrodes may be all the same or partially the same, or may be different from each other. These materials may be appropriately selected, for example from the materials of the element electrodes 402 and 403 (see FIG. 2). If the material forming the element electrodes is the same as the material forming the wiring, then the wiring connected to the element electrodes can also be called an element electrode.

A scan signal imparting device (not shown) that imparts scan signals in order to select a row of the electron emitting elements 474 aligned in the X direction is connected to the X direction wiring 472. In contrast, a modulation signal generating device (not shown) that modulates each row of the electron emission elements 474 aligned in the Y direction in accordance with input signals is connected to the Y direction wiring 473. The drive voltage applied to each electron emission element is supplied as a differential voltage between the scan signal and the modulation signal imparted to that element.

In the above structure, it is possible to select and drive individual elements independently using a simple matrix layout.

A description will now be given using FIG. 22 of an image formation device constructed using an electron source having this type of simple matrix layout.

Figure 22:
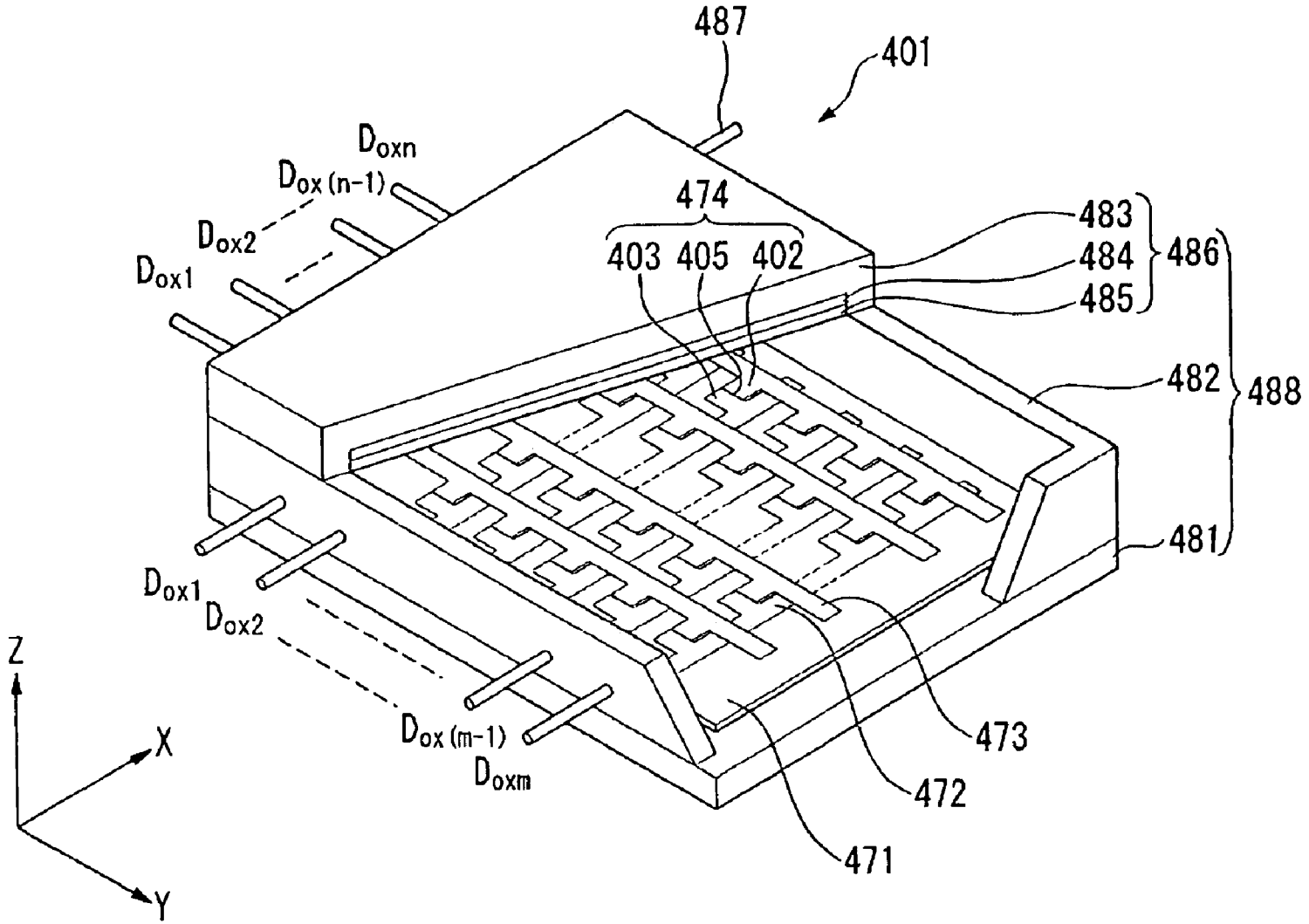
FIG. 22 is a typical view showing an example of display panel of an image forming apparatus according to the fourth embodiment.

FIG. 22 is a typical view showing an example of a display panel 401 of an image display device.

In FIG. 22, 471 is an electron source substrate on which are arranged a plurality of electron emission elements. 481 is a rear plate to which the electron source substrate 471 is fixed. 486 is a face plate having a glass substrate 483 with a fluorescent film 484 and a metal back 485 and the like formed on an inner surface of the glass substrate 483. 482 is a supporting frame and the rear plate 481 and face plate 486 are connected to the supporting frame 482 using frit glass or the like. 488 is an envelope that can be sealed, for example by being baked for 10 minutes or more in a temperature range of 400 to 500° C. in air or in nitrogen.

474 are electron emission elements. 472 and 473 are X direction wiring and Y direction wiring connected to a pair of emission electrodes of surface conduction electron emission elements. As described above, the envelope 488 is formed by the face plate 486, the supporting frame 482, and the rear plate 481. Because the real plate 481 is provided mainly in order to reinforce the strength of the substrate 471, if the substrate 471 has sufficient strength by itself, it is possible to do away with a separate rear plate 481. Namely it is also possible seal the supporting frame 482 directly to the substrate 471 and form the envelope 488 using the face plate 486, the supporting frame 482, and the substrate 471. By providing a supporting body (not shown), known as a spacer, between the face plate 486 and the rear plate 481, the envelope 481 can be formed with sufficient strength to combat air pressure.

The fluorescent film 484 can be formed using only a fluorescent body in the case of a monochrome film. In the case of a color fluorescent film, this can be formed from fluorescent bodies and black conductive material (neither of which are shown in the drawings) called black stripes or a black matrix using rows of fluorescent bodies. One reason for providing black stripes or a black matrix is, in the case of a color display, to prevent color mixing and the like from becoming prominent by blackening the separately coated portions between each fluorescent body of the three primary color fluorescent bodies that are needed. Another reason is to suppress any reduction in contrast in the fluorescent film 484 caused by external light reflection. In addition to materials having graphite as their main component that are normally used, any material that is conductive and has little light permeability and reflection can be used as the black conductive material.

In this case, as the method for coating the fluorescent body on the glass substrate 483, regardless of whether it is monochrome or color, a coating method such as a precipitation method or a printing method may be used. Alternatively, an inkjet method using the film forming apparatus 10 described in the first embodiment may be employed. A normal metal back 485 is provided on an inner surface side of the fluorescent body 484. The reason for providing a metal back is to improve brightness by creating a mirror reflection which causes the part of the light emitted by the fluorescent body that strikes the inner surface side to be reflected towards the face plate 486. Another reason is that the metal back operates as an electrode to apply electron beam acceleration voltage, and a further reason is so as to protect the fluorescent body from damage caused by collisions with negative ions generated inside the envelope. The metal back is manufactured by first creating, the fluorescent film and then performing a smoothing processing (usually known as a "filming") on the surface on the inner surface side of the fluorescent film. Al is then accumulated by vacuum evaporation or the like.

In order to further raise the conductivity of the fluorescent film 484 a transparent electrode (not shown) may be provided on the outer surface side of the fluorescent film 484 in the face plate 486. When performing the sealing process mentioned above, in the case of color it is necessary to match the respective fluorescent body of each color with an electron emission element and the proper positioning is absolutely essential.

The image forming apparatus shown in FIG. 22 may be manufactured, for example, in the manner described below.

While an appropriate degree of heat is being applied air inside the envelope 488 is removed via an air release pipe (not shown) by an air removal apparatus that does not employ oil such as an ion pump, an absorption pump, or the like. The interior of the envelope 488 is thereby placed in an atmosphere having a degree of vacuum of $1.3\times10^{-3}$ Pa and having a sufficiently low quantity of organic matter therein, and the envelope 498 is then sealed. In order to maintain the degree of vacuum after the envelope 488 has been sealed, getter processing can also be performed. This processing involves heating a getter (not shown), which is placed in a predetermined position inside the envelope 489, either immediately before the envelope 488 is sealed or after it has been sealed, using heat provided by resistance heating or high frequency heating or the like, resulting in the formation of an evaporated film. The getter normally has Ba as the principal constituent thereof and maintains a degree of vacuum of, for example, $1.3\times10^{-5}$ Pa or more by an adsorption action of the evaporated film. Here, the steps after the forming processing of the electron emission element can be set as is appropriate.

The display panel 401 is connected with an external electrical circuit via terminals $D_{ox1}$ through $D_{oxm}$, terminals $D_{oy1}$ through $D_{oyn}$, and a high pressure terminal 487. Scan signals air applied to the terminals $D_{ox1}$ through $D_{oxm}$ in order to drive an electron source provided within the display panel, namely, to drive one line (n elements) at a time in sequence of a group of electron emission elements laid out in a matrix configuration having m number of lines and m number of rows. Modulation signals are applied to the terminals $D_{oy1}$ through $D_{oyn}$ in order to control output electron beams of each element of the electron emission elements of the one line selected by the scan signals. Direct current voltage of, for example, 10 kV is supplied from a DC power source to the high pressure terminal 487. This is an acceleration voltage that imparts sufficient energy to the electron beams emitted from the electron emission elements to excite the fluorescent bodies.

In an image forming apparatus in which the present invention having this type of structure can be applied, by applying voltage via the outside terminals $D_{ox1}$ through $D_{oxm}$ and $D_{oy1}$ through $D_{oyn}$ to each electron emission element, electron emission is generated. High pressure is applied to the metal back 485 or the transparent electrode (not shown) via the high pressure terminal 487, and electron beams are accelerated. The accelerated elections collide with the fluorescent film 484, light emission is generated and an image is formed.

In this way, in the present embodiment, particularly when a liquid composed of a pseudoplastic fluid body is used as the liquid containing a fluorescent body for forming the fluorescent film 484, because it is possible to lower the viscosity of the liquid without heating the liquid a stable discharge from the head is made possible even when using a high viscosity liquid or a liquid that cannot be heated or even a liquid that has rapid drying properties. This enables a film with desired discharge characteristics to be formed on a substrate. As a result, the image forming apparatus 401 that is manufactured using a liquid discharged from the inkjet head 20 can be provided with a film having a desired configuration and size, thereby enabling product quality to be maintained.

Moreover, in the present embodiment, because vibration is imparted to the liquid during a wait time when the liquid is not being discharged, it is possible to keep the liquid inside the inkjet head 20 constantly at a low viscosity. Furthermore, because the piezoelectric elements 92 that are driven when the liquid is discharged from the inkjet head 20 also function as pressure generating devices to form the micro vibration waveforms W2 that do not discharge the liquid, there is no need to provide separate vibration imparting devices enabling the apparatus to be reduced in both size and cost. Moreover, because no liquid heating device is provided, there is no wait time until the liquid reaches a predetermined temperature, thereby providing excellent productivity. Moreover, because there is no need to apply a high voltage to the pressure generating devices the lifespan of the pressure generating devices can be lengthened.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as limited by the foregoing description but is only limited by the scope of the appended claims.

For example, in the above embodiments a structure is employed in which ink is discharged from a head by the drive of piezoelectric elements operating as pressure generating devices however, the present invention may also be applied to a structure in which a heater (i.e., a foam generating apparatus) is provided inside the head, and ink is discharged by foam generated by the heat from this heater under the control of a control device. In this case, during the wait time when ink is not being discharged, it is possible to continuously perform the driving and stopping of the heater within a range where the ink is not discharged, and to impart vibration to the ink by enlarging and contracting the foam. This allows the same operation and effects as are provided by the use of piezoelectric elements to be obtained.

In addition to the embodiments described above, it is also possible to apply the film forming apparatus, for example, to a printer (plotter) that prints or forms a film on printing paper and the like.

Furthermore, if a metal material and insulating material is provided for the film forming apparatus of the present invention, in addition to the above embodiments, the present invention can be applied to direct, fine patterning, such as metal wiring and insulating film and the like, and to the creation of new, high performance devices.

Note that in the above embodiments, for convenience, the terms "inkjet apparatus" and "inkjet head" are used and the discharged material is referred to as "ink", however, the discharged material that is discharged from this inkjet head is not limited to what is commonly called ink and any material that can be adjusted so as to be capable of being discharged from a head in liquid drop form is sufficient. For example, it should be understood that this term also includes a variety of materials such as EL device materials, metal materials, insulating materials, semiconductor materials and the like.

Moreover, the inkjet head 20 of the film forming apparatus shown in the drawings is able to discharge one type of ink out of red (R), green (G), and blue (B) inks, however, it is of course possible for two types or three types of these inks to be discharged simultaneously. In addition, linear motors are used in the first transporting unit 14 and second transporting unit 16 of the film forming apparatus 10, however, the present invention is not limited to this and other types of motors and actuators may also be used.

CROSS REFERENCE TO RELATED APPLICATIONS

This application claims priority to Japanese application No. 2002-266975 filed Sep. 12, 2002 and Japanese application No. 2003-206587 filed Aug. 7, 2003, both of which are hereby incorporated by reference.

What is claimed is:

1. A method of driving a film forming apparatus that discharges liquid drops by imparting vibrations to a liquid, comprising the steps of controlling the vibrations by:

a first signal that causes liquid drops to be discharged; and a second signal that does not cause liquid drops to be discharged and that imparts a shear rate to the liquid that lowers a viscosity of the liquid, wherein the liquid is a non-newtonian, pseudoplastic fluid body, and the second signal is not transmitted if the length of a time interval between a time when the first signal is transmitted and a time when the first signal is transmitted again is shorter than a predetermined length of time.

2. The method of driving a film forming apparatus, according to claim 1, wherein the second signal is transmitted before the first signal is transmitted.

3. The method of driving a film forming apparatus, according to claim 1, wherein the second signal is transmitted after the first signal is transmitted.

4. The method of driving a film forming apparatus, according to claim 1, wherein the second signal is transmitted at least once after a time when the first signal is transmitted and before a time when the first signal is transmitted again.

5. A method of manufacturing a device, comprising the steps of:

forming a film on a substrate as a result of liquid drops being discharged by a liquid drop discharge apparatus, wherein the liquid drop discharge apparatus driven by the method of driving a film forming apparatus according to claim 1.

* * * * *

UNITED STATES PATENT AND TRADEMARK OFFICE

CERTIFICATE OF CORRECTION

PATENT NO. : 7,066,583 B2
APPLICATION NO. : 10/660467
DATED : June 27, 2006
INVENTOR(S) : Takahiro Usui It is certified that error appears in the above-identified patent and that said Letters Patent is hereby corrected as shown below:

Title Page, No. (30) Foreign Application Priority Data: "2003-266975" should be -- 2002-266975 --.

Col. 1, lines 35-36: "capacity" should be -- cavity --.

Col. 2, line 55: "call" should be -- can --.

Col. 3, line 63: "am" should be -- an --.

Col. 3, line 64: After "discharge", insert -- waveform. --.

Col. 4, line 9: "chair" should be -- chart --.

Col. 4, line 46: "flow" should be -- now --.

Col. 5, line 46: "units if" should be -- unit. If --.

Col. 5, line 55: "a" should be --*a*--.

Col. 5, line 58: After "swung", insert -- in --.

Col. 8, line 16: "bead" should be -- head --.

Col. 8, line 61: "into" should be -- onto --.

Col. 8, line 62: After "head", insert -- 20 --.

Col. 9, line 4: "in" should be -- will --.

Col. 9, line 39: "loan," should be -- long --.

Col. 10, line 6: "fuller" should be -- further --.

Col. 10, line 30: After "function", "is" should be -- as --.

Col. 11, line 2: "older" should be -- order --.

UNITED STATES PATENT AND TRADEMARK OFFICE

CERTIFICATE OF CORRECTION

PATENT NO. : 7,066,583 B2
APPLICATION NO. : 10/660467
DATED : June 27, 2006
INVENTOR(S) : Takahiro Usul It is certified that error appears in the above-identified patent and that said Letters Patent is hereby corrected as shown below:

Col. 11, line 10: After “layer”, delete “or”.

Col. 11, line 44: “912” should be -- 212 --.

Col. 11, line 58: “filly)” should be -- film --.

Col. 12, lines 20-21: “injection transporting” should be -- injection/transporting --.

Col. 12, line 29: “injection transporting” should be -- injection/transporting --.

Col. 12, line 65: “injection transporting” should be -- injection/transporting --.

Col. 12, line 67: “209” should be -- 208 --.

Col. 13, line 21: “rising” should be -- using --.

Col. 14, line 23: “injections transporting” should be -- injection/transporting --.

Col. 14, line 39: “injections transporting” should be -- injection/transporting --.

Col. 14, line 53: “dry in,” should be -- drying --.

Col. 15, line 24: After “(B)”, insert -- is formed. --.

Col. 15, line 39: After “hole”, delete “in”.

Col. 17, line 1: “from” should be -- form --.

Col. 17, line 22: “others” should be -- other --.

Col. 17, line 54: “all” should be -- an --.

Col. 18, line 19: “generation” should be -- generating --.

Col. 19, line 5: “substance” should be -- substrate --.

Col. 19, line 34: “die” should be -- the --.

UNITED STATES PATENT AND TRADEMARK OFFICE

CERTIFICATE OF CORRECTION

PATENT NO. : 7,066,583 B2
APPLICATION NO. : 10/660467
DATED : June 27, 2006
INVENTOR(S) : Takahiro Usul It is certified that error appears in the above-identified patent and that said Letters Patent is hereby corrected as shown below:

Col. 21, line 18: “498” should be -- 488 --.

Col. 21, line 22: “489” should be -- 488 --.

Col. 21, line 35: “air” should be -- are --.

Col. 21, line 56: “elections” should be -- electrons --.

Signed and Sealed this

Sixth Day of March, 2007

JON W. DUDAS
*Director of the United States Patent and Trademark Office*